US008366224B2

(12) United States Patent
Yokota et al.

(10) Patent No.: US 8,366,224 B2
(45) Date of Patent: Feb. 5, 2013

(54) INKJET RECORDING APPARATUS

(75) Inventors: Yasuyo Yokota, Kanagawa-ken (JP); Masahito Katada, Kanagawa-ken (JP); Yuko Katada, legal representative, Ebina (JP); Hiroshi Shibata, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 522 days.

(21) Appl. No.: 12/569,527

(22) Filed: Sep. 29, 2009

(65) Prior Publication Data

US 2010/0085396 A1 Apr. 8, 2010

(30) Foreign Application Priority Data

Sep. 30, 2008 (JP) ..... 2008-255229

(51) Int. Cl.
*B41J 2/195* (2006.01)
*B41J 2/175* (2006.01)
*B41J 2/17* (2006.01)

(52) U.S. Cl. ..... 347/7; 347/85; 347/84

(58) Field of Classification Search ..... 347/7, 84–85
See application file for complete search history.

(56) References Cited

U.S. PATENT DOCUMENTS 4,825,228 A * 4/1989 Gloeckler et al. ..... 347/7
6,224,201 B1 5/2001 Shigemura
2005/0270340 A1* 12/2005 Mita ..... 347/71
2007/0126816 A1* 6/2007 Nishida ..... 347/85
2008/0158307 A1* 7/2008 Nitta et al. ..... 347/85
2008/0211841 A1 9/2008 Kojima et al.
2009/0046132 A1* 2/2009 Izawa et al. ..... 347/85

FOREIGN PATENT DOCUMENTS

JP 11-42795 A 2/1999
JP 2000-190529 A 7/2000
JP 2000-280493 A 10/2000
JP 2005-59476 A 3/2005
JP 2007-313817 A 6/2007
JP 2007-245655 A 9/2007
JP 2008-162262 A 7/2008
JP 2008-213279 A 9/2008

* cited by examiner

*Primary Examiner* — Stephen Meier
*Assistant Examiner* — Sarah Al Hashimi
(74) *Attorney, Agent, or Firm* — Birch, Stewart, Kolasch & Birchh & LLP

(57) ABSTRACT

Inkjet apparatus includes: a tank; a first flow channel; a first liquid chamber; a second flow channel; a second liquid chamber; a first liquid movement; a second liquid movement device; a first pressure determination device; a second pressure determination device; a pressure control device which controls pressures in the first and second liquid chambers by respectively controlling the first and second liquid movement devices, in accordance with determination results of the first and second pressure determination devices, in such a manner that the internal pressures of the first and second liquid chambers respectively remain at the target pressures; a circulation path through which the liquid inside the first liquid chamber is circulated without passing through the inkjet head; and a deaeration device which is provided at an intermediate point of the circulation path and which removes dissolved gas.

15 Claims, 14 Drawing Sheets

FIG.15

| INK CIRCULATION PATH | AMOUNT OF DISSOLVED OXYGEN | INCREASE IN VISCOSITY OF INK IN VICINITY OF EJECTION PORTS | RATE OF NOZZLES WITH EJECTION FAILURE AFTER ONE HOUR | WARM UP TIME |
|---|---|---|---|---|
| PRACTICAL EXAMPLE 1 | 10 TO 20% | NO | LESS THAN 1% | 20 MIN. |
| PRACTICAL EXAMPLE 2 | 10 TO 20% | NO | LESS THAN 1% | 15 MIN. |
| PRACTICAL EXAMPLE 3 | 10 TO 20% | NO | LESS THAN 1% | 10 MIN. |
| COMPARATIVE EXAMPLE 1 | 20 TO 40% | YES | 3% | 20 MIN. |
| COMPARATIVE EXAMPLE 2 | 40 TO 70% | NO | 8% | 40 TO 60 MIN. |
| COMPARATIVE EXAMPLE 3 | 20 TO 40% | NO | 3% | 40 MIN. |

INKJET RECORDING APPARATUS

BACKGROUND OF THE INVENTION

1. Field of the Invention

The present invention relates to an inkjet recording apparatus, and more particularly, to technology for supplying satisfactory deaerated ink to an inkjet head.

2. Description of the Related Art

An inkjet recording apparatus that forms an image by ejecting ink from a recording head (an inkjet head) to a recording medium has many merits as follows. An image of high accuracy can be formed by a small recording head in which a plurality of nozzles are arranged at high density. Moreover, by aligning a plurality of recording heads and supplying different inks of a plurality of colors to the recording heads, a color image is obtained by means of a small and inexpensive composition. Furthermore, by aligning heads substantially in a line configuration, it is possible to record over large format recording medium having a broad width.

In an inkjet recording apparatus of this kind, it is important that the ejection of ink from the recording head be stable. In particular, normally, a certain quantity of gas is dissolved into the ink (dissolved gas) and forms gas bubbles inside the ink flow channels and the recording head, which can give rise to negative effects such as inhibiting the flow of ink and producing ejection failures in which no ink is ejected. Therefore, a composition incorporating a deaeration device which performs deaeration processing of the ink supplied to the recording head is adopted, or alternatively the ink to be used is previously subjected to deaeration and then packaged.

Japanese Patent Application Publication No. 11-042795 describes a composition in which a deaeration device is provided at an intermediate point of the ink supply channel for supplying ink inside a tank to an inkjet head, and furthermore, an ink circulation path for returning the ink that has passed through the deaeration device to the tank is provided in order to prevent gas bubbles and dissolved gas in the ink, which give rise to ink ejection failures and ejection instability, from entering into the inkjet head.

Japanese Patent Application Publication No. 2005-059476 describes a composition in which a return flow channel is provided for returning ink to a sub tank from before the ink ejection port in a head section, and furthermore a deaeration device is provided in the return flow channel or a first flow channel (a flow channel that conveys ink from a main tank to the sub tank).

However, in the composition described in Japanese Patent Application Publication No. 11-042795, since deaeration is performed after returning ink to a main tank in which ink is stored or to a sub tank in which ink is held temporarily, then consequently the circulated ink volume becomes large. Therefore, it is necessary to provide a deaeration device having a large capacity and hence there is a drawback in that the apparatus costs become high. Furthermore, there is a possibility that air will dissolve into the ink held in the main tank, and hence there is also a problem of decline in the deaeration efficiency. Moreover, since the deaeration device is provided between the inkjet head and the sub tank, then there are also problems in that a pressure loss occurs in the deaeration device, pressure adjustment in the inkjet head becomes difficult to achieve and the ink ejection state becomes instable. Furthermore, if left for a long period of time, air dissolves again into the ink held in the sub tank, the beneficial effects of deaeration are not obtained and there is a possibility that ejection defects will occur.

Moreover, in the composition described in Japanese Patent Application Publication No. 2005-059476, the deaeration device is not provided in the second flow channel (the flow channel that conveys ink from the ink tank to the head), and therefore although it is possible to prevent pressure loss from the sub tank to the head section, the ink flow channels formed inside the head section is narrower than the other flow channels (the flow channels that connect the main tank and the sub tank, or the flow channels that connect the sub tank and the head section, for instance) and therefore produce greater flow channel resistance, thus restricting the flow volume which can be circulated in each module (head chip). Consequently, if the volume of ink into which gas dissolves in the sub tank per unit time exceeds the volume of ink that is deaerated, then the amount of dissolved gas will not be reduced sufficiently, and ink containing a large amount of dissolved gas will be supplied to the head section, thereby giving rise to ejection defects.

Furthermore, using ink which has already undergone deaeration processing is expensive in itself, and the replenishment and management of the ink involves a great amount of work.

SUMMARY OF THE INVENTION

The present invention has been contrived in view of the foregoing circumstances, an object thereof being to provide an inkjet recording apparatus in which ejection stability is improved by supplying good deaerated ink to an inkjet head while suppressing ejection defects caused by increased viscosity of the ink in the vicinity of the nozzles (ejection ports).

In order to attain the aforementioned object, the present invention is directed to an inkjet recording apparatus, comprising: a tank inside which liquid is stored; a first flow channel through which the liquid inside the tank is supplied to an inkjet head; a first liquid chamber which is provided at an intermediate point of the first flow channel and which temporarily holds the liquid supplied from the tank; a second flow channel through which the ink circulated inside the inkjet head is returned to at least one of the tank and the first flow channel; a second liquid chamber which is provided at an intermediate point of the second flow channel and which temporarily holds the liquid recovered from the inkjet head; a first liquid movement device which is provided at the intermediate point of the first flow channel; a second liquid movement device which is provided at the intermediate point of the second flow channel; a first pressure determination device which determines an internal pressure of the first liquid chamber; a second pressure determination device which determines an internal pressure of the second liquid chamber; a pressure control device which sets respective target pressures for the first and second liquid chambers in such a manner that while a prescribed back pressure is applied to the liquid inside nozzles of the inkjet head, a prescribed pressure differential is provided between the first and second liquid chambers, and which controls pressures in the first and second liquid chambers by respectively controlling the first and second liquid movement devices, in accordance with determination results of the first and second pressure determination devices, in such a manner that the internal pressures of the first and second liquid chambers respectively remain at the target pressures; a circulation path through which the liquid inside the first liquid chamber is circulated without passing through the inkjet head; and a deaeration device which is provided at an intermediate point of the circulation path and which removes dissolved gas in the liquid, wherein the circulation path is provided with at least one of a third liquid movement device and the first and second liquid movement devices.

According to this aspect of the present invention, by controlling the pressures in such a manner that a prescribed pressure differential is produced between the internal pressures of the first and second liquid chambers, it is possible to circulate the liquid from the first liquid chamber to the second liquid chamber through the inkjet head, while maintaining the back pressure (negative pressure) of the inkjet head, and therefore ejection defects caused by increased viscosity of the liquid in the vicinity of the nozzles can be suppressed. Furthermore, since the liquid inside the first liquid chamber can be circulated while performing deaeration by the deaeration device, without passing through the inkjet head, it is possible to promote the removal of dissolved gas in the liquid, irrespectively of the ejection status of the inkjet head or the volume of liquid being circulated, and ejection defects caused by the occurrence of gas bubbles can be suppressed. Hence, the ejection stability of the inkjet head is improved and images of good quality can be achieved.

Preferably, the inkjet recording apparatus further comprises: a third flow channel of which one end is connected to the first liquid chamber and the other end is connected to the second liquid chamber, wherein the circulation path includes the third flow channel.

According to this aspect of the present invention, the liquid inside the first liquid chamber can be circulated while being deaerated by the deaeration device through the third flow channel which connects between the first and second liquid chambers, without passing through the inkjet head.

Preferably, the deaeration device is provided at an intermediate point of the first flow channel between a point of connection with the second flow channel and the first liquid chamber.

According to this aspect of the present invention, the liquid that is supplied to the inkjet head from the tank through the first liquid chamber can also be subjected to deaeration processing.

Preferably, the inkjet recording apparatus further comprises: a third flow channel of which both ends are respectively connected to the first liquid chamber, wherein: the third liquid movement device and the deaeration device are provided at an intermediate point of the third flow channel; and the circulation path includes the third flow channel.

According to this aspect of the present invention, by providing the deaeration device in the third flow channel (circulation flow channel) both ends of which are connected to the first liquid chamber, there is no need to provide a deaeration device in the first flow channel or the second flow channel, and hence the effects of pressure variation caused by pressure loss in the deaeration device can be reduced, and the highly accurate pressure control can be performed in respect of the first and second liquid chambers.

Preferably, the inkjet recording apparatus further comprises: a dissolved gas amount measurement device which measures an amount of dissolved gas contained in the liquid supplied to the inkjet head; and a flow volume control device which controls a volume of the liquid passing through the third flow channel according to the amount of dissolved gas measured by the dissolved gas amount measurement device.

According to this aspect of the present invention, by controlling the liquid volume passing through the third flow channel in accordance with the volume of dissolved gas measured by the dissolved gas volume measurement device, it is possible to promote more the removal of the dissolved gas in the liquid more effectively.

Preferably, the inkjet recording apparatus further comprises: a liquid consumption volume calculation device which calculates a liquid consumption volume consumed by the inkjet head in accordance with input image data and a number of prints; and a liquid supply volume control device which controls a volume of liquid supplied to the first liquid chamber from the tank, by controlling the first liquid movement device according to the liquid consumption volume calculated by the liquid consumption volume calculation device.

According to this aspect of the present invention, the amount of the liquid supplied from the tank to the first liquid chamber is controlled in accordance with the liquid use volume which is to be consumed by the inkjet head, on the basis of the image data and the number of prints, and therefore it is possible to shorten the warn up time (preparation time) required for deaeration processing by circulating the liquid after the start up of the apparatus (or after an idle state of the apparatus).

Preferably, an interior of the tank is connected to outside air. According to this aspect of the present invention, by opening the interior of the tank to the air, it is possible to control the internal pressures of the respective liquid chambers independently, without the liquid that has flowed out to the tank from the first liquid chamber or the second liquid chamber ending up in a dead-end situation.

Preferably, two sub tanks each having a liquid chamber and a gas chamber formed by partitioning an interior of a sealed container by means of a flexible film are provided; and the liquid chamber of one of the two sub tanks serves as the first liquid chamber and the liquid chamber of the other of the two sub tanks serves as the second liquid chamber.

According to this aspect of the present invention, it is possible to attenuate pressure variation caused by movement of the liquid by means of the flexible film and the gas chamber, and hence the pressure variation is not transmitted to the inkjet head and therefore good print quality can be ensured. Furthermore, highly accurate pressure adjustment can be achieved.

According to the present invention, by controlling the pressures in such a manner that a prescribed pressure differential is produced between the internal pressures of the first and second liquid chambers, it is possible to circulate the liquid from the first liquid chamber to the second liquid chamber though the inkjet head, while maintaining the back pressure (negative pressure) of the inkjet head, and therefore ejection defects caused by increased viscosity of the liquid in the vicinity of the nozzles can be suppressed. Furthermore, since the liquid inside the first liquid chamber can be circulated while performing deaeration by the deaeration device, without passing through the inkjet head, it is possible to promote the removal of dissolved gas in the liquid, irrespectively of the ejection status of the inkjet head or the volume of liquid being circulated, and ejection defects caused by the occurrence of gas bubbles can be suppressed. Hence, the ejection stability of the inkjet head is improved and images of good quality can be achieved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 15 is a table showing the results of evaluation experiments.

DETAILED DESCRIPTION OF THE PREFERRED EMBODIMENTS

General Configuration of Inkjet Recording Apparatus

Figure 1:
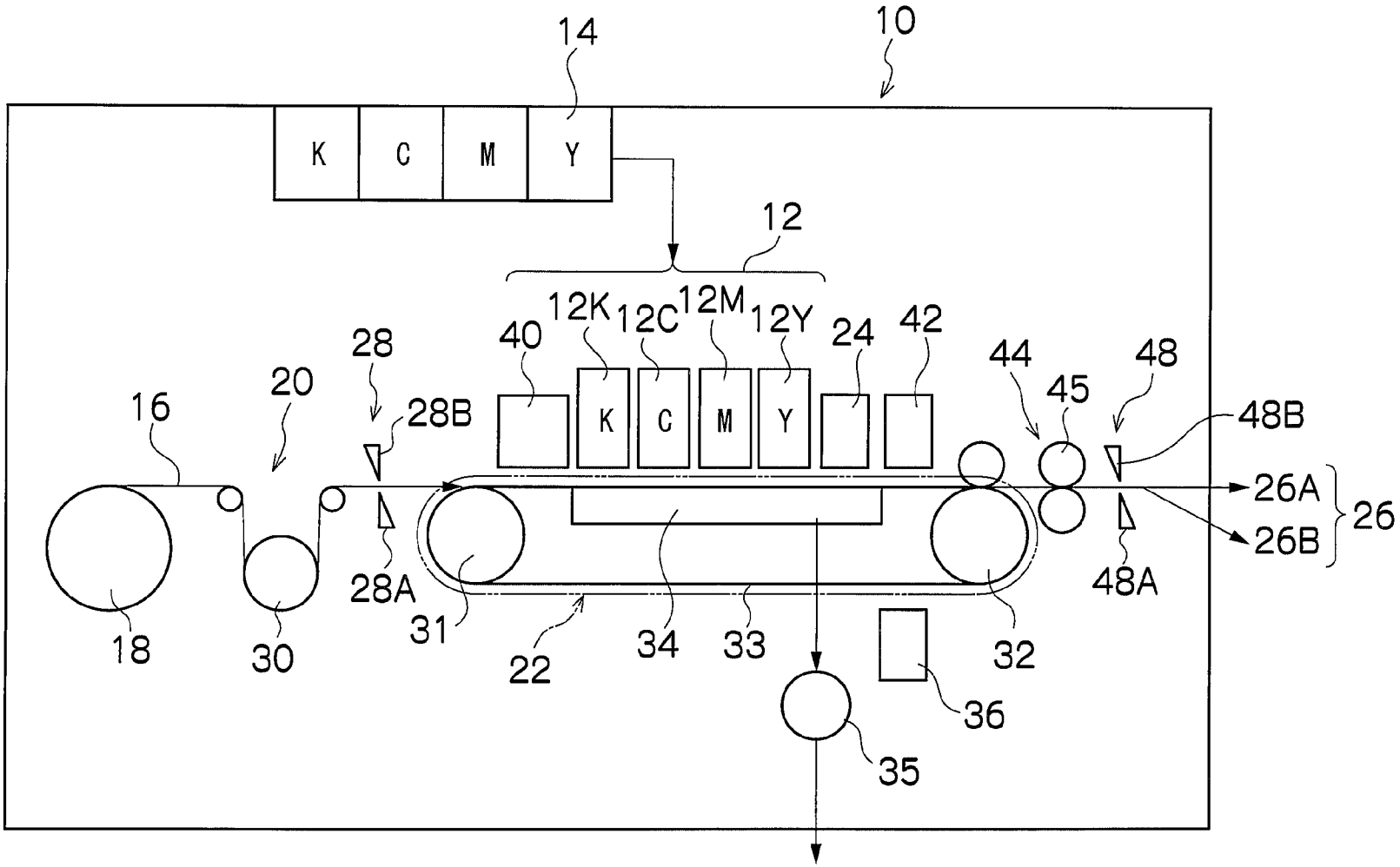
FIG. 1 is a general schematic drawing showing a general view of an inkjet recording apparatus.

FIG. 1 is a general configuration diagram of an inkjet recording apparatus according to an embodiment of the present invention. As illustrated in FIG. 1, the inkjet recording apparatus 10 includes: a printing unit 12 having a plurality of recording heads (hereafter, also simply called "heads") 12K, 12C, 12M, and 12Y provided for the respective ink colors; an ink storing and loading unit 14 for storing inks of K, C, M and Y to be supplied to the printing heads 12K, 12C, 12M, and 12Y; a paper supply unit 18 for supplying recording paper 16; a decurling unit 20 removing curl in the recording paper 16; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of the configuration in which roll paper is used, a cutter 28 is provided as illustrated in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as illustrated in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, and a combination of these. In the case of the configuration in which the belt 33 is nipped with the cleaning rollers, it is preferable to make the line velocity of the cleaning rollers different from that of the belt 33 to improve the cleaning effect.

A roller nip conveyance mechanism, in place of the suction belt conveyance unit 22, can be employed. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The printing unit 12 is a so-called "full line head" in which a line head having a length corresponding to the maximum paper width is arranged in a direction (main scanning direction) that is perpendicular to the paper conveyance direction (sub scanning direction).

Figure 2:
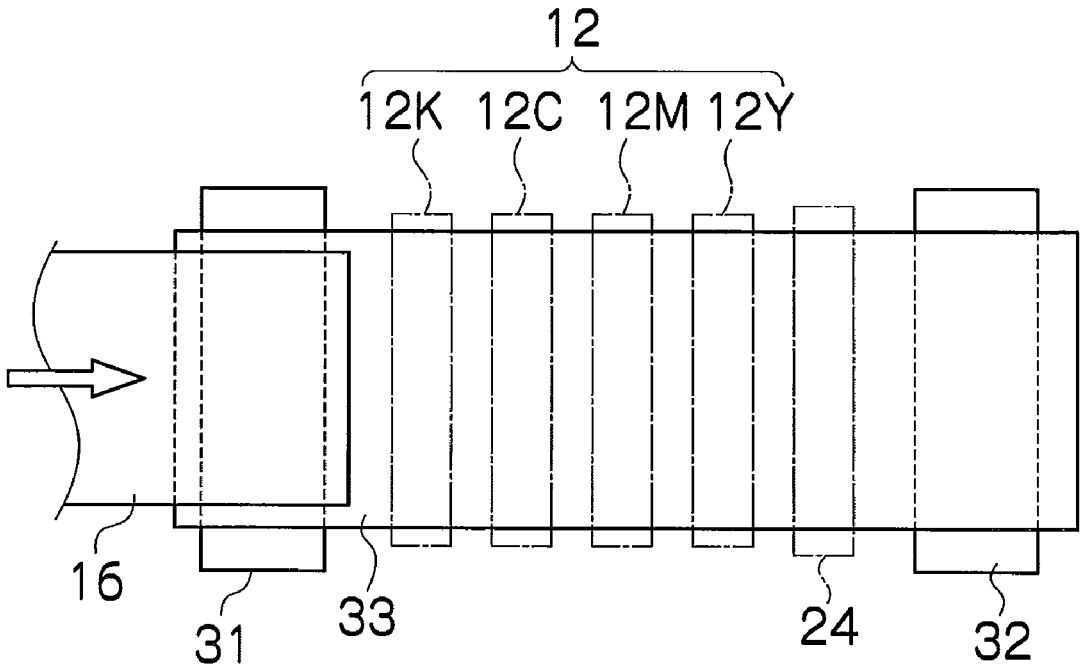
FIG. 2 is a principal plan diagram showing the peripheral area of a print unit of an inkjet recording apparatus.

Each of the printing heads 12K, 12C, 12M, and 12Y constituting the printing unit 12 is constituted by a line head, in which a plurality of ink ejection ports (nozzles) are arranged along a length that exceeds at least one side of the maximum-size recording paper 16 intended for use in the inkjet recording apparatus 10 (see FIG. 2).

The printing heads 12K, 12C, 12M, and 12Y are arranged in the order of black (K), cyan (C), magenta (M), and yellow (Y) from the upstream side, along the feed direction of the recording paper 16 (hereinafter, referred to as the sub-scanning direction). A color image can be formed on the recording paper 16 by ejecting the inks from the printing heads 12K, 12C, 12M, and 12Y, respectively, onto the recording paper 16 while conveying the recording paper 16.

By adopting the printing unit 12 in which the full line heads covering the full paper width are provided for the respective ink colors in this way, it is possible to record an image on the full surface of the recording paper 16 by performing just one operation of relatively moving the recording paper 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a head reciprocates in a direction (the main scanning direction) orthogonal to the paper conveyance direction.

Although the configuration with the KCMY four standard colors is described in the present embodiment, combinations of the ink colors and the number of colors are not limited to those. Light inks or dark inks can be added as required. For example, a configuration is possible in which heads for ejecting light-colored inks such as light cyan and light magenta are added. Furthermore, there are no particular restrictions of the sequence in which the heads of respective colors are arranged.

As illustrated in FIG. 1, the ink storing and loading unit 14 has tanks for storing the inks of K, C, M and Y to be supplied to the heads 12K, 12C, 12M, and 12Y and the tanks are connected to the heads 12K, 12C, 12M, and 12Y by means of channels, which are omitted from figures. The ink storing and loading unit 14 has a warning device (for example, a display device or an alarm sound generator) for warning when the remaining amount of any ink is low, and has a mechanism for preventing loading errors among the colors.

The print determination unit 24 has an image sensor (line sensor) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the heads 12K, 12C, 12M, and 12Y for the respective colors, and the ejection of each head is determined The ejection determination includes measurement of the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substances that cause dye molecules to break down, and has the effect of increasing the durability of the print.

A heating/pressing unit 44 is disposed following the post-drying unit 42. The heating/pressing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not illustrated in FIG. 1, the paper output unit 26A for the target prints is provided with a sorter for collecting prints according to print orders.

Structure of the Head

Next, the structure of heads 12K, 12C, 12M and 12Y will be described. The heads 12K, 12C, 12M and 12Y of the respective ink colors have the same structure, and a reference numeral 50 is hereinafter designated to any of the heads.

Figure 3A:
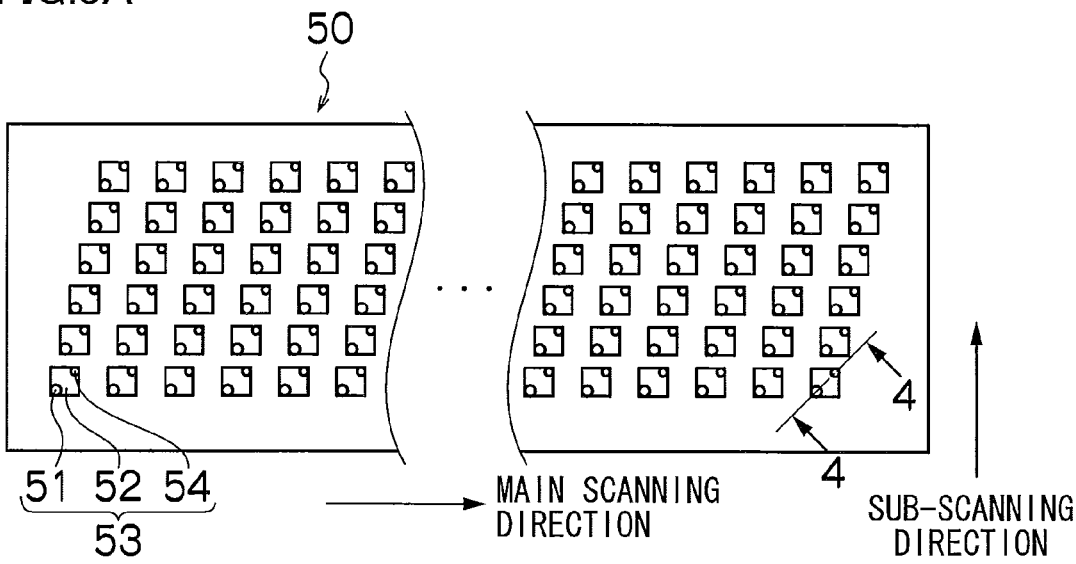
FIGS. 3A to 3C are plan view perspective diagrams showing examples of the composition of a print head.
Figure 3B:
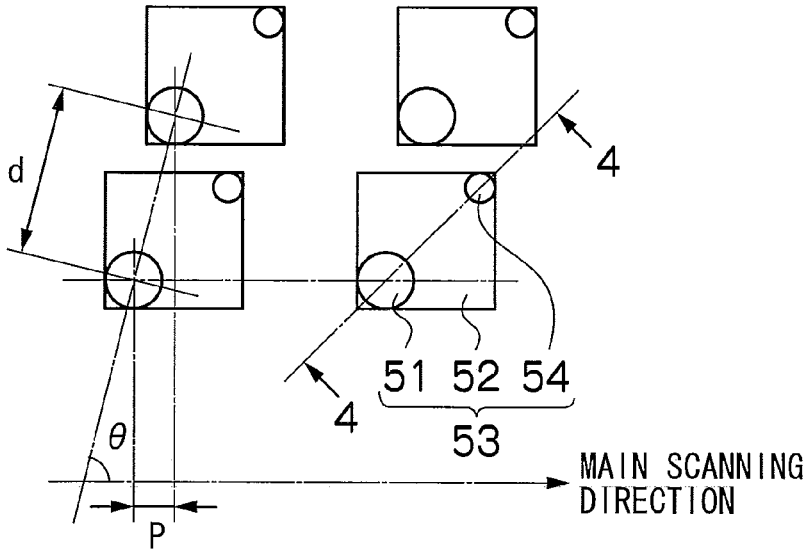
Figure 3C:
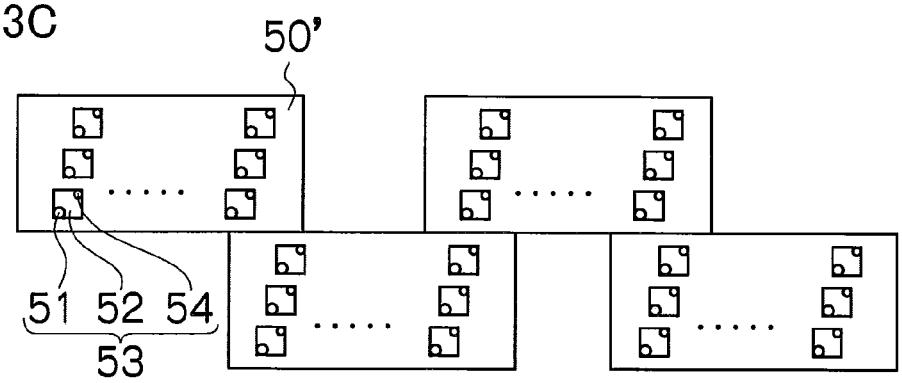
Figure 4:
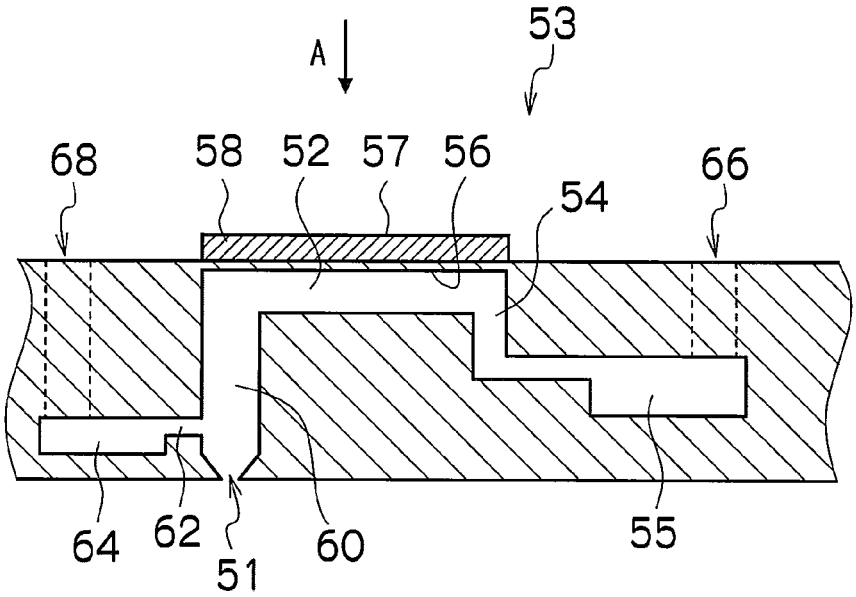
FIG. 4 is a cross-sectional diagram showing the three-dimensional composition of an ink chamber unit.
Figure 5:
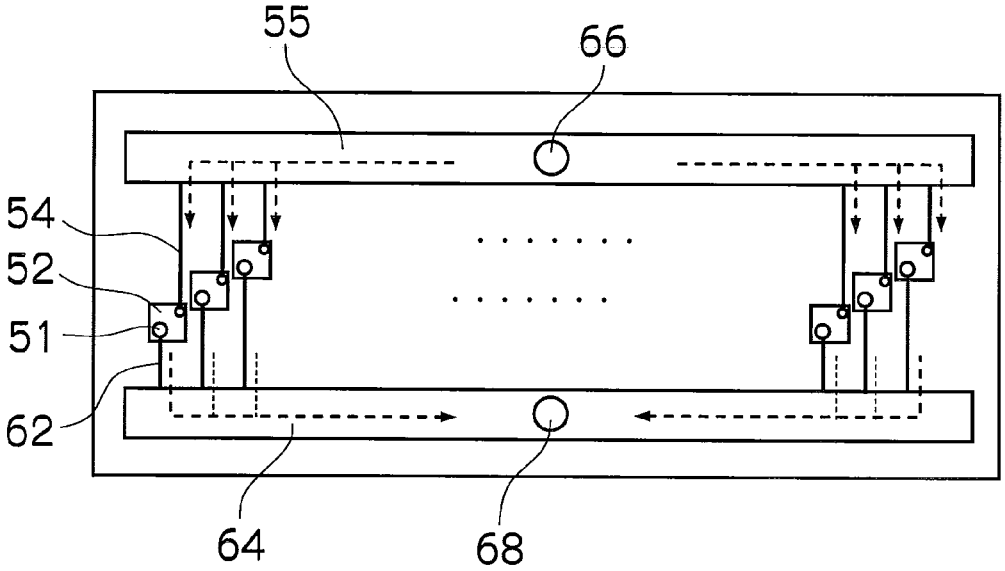
FIG. 5 is a flow channel schematic drawing showing the structure of flow channels inside a head.

FIG. 3A is a plan perspective diagram showing an example of the structure of a head 50, and FIG. 3B is a partial enlarged diagram of same. Moreover, FIG. 3C is a plan view perspective diagram showing a further example of the structure of the head 50. FIG. 4 is a cross-sectional diagram showing the composition of an ink chamber unit (a cross-sectional diagram along line 4-4 in FIGS. 3A and 3B). Furthermore, FIG. 5 is a flow channel composition diagram showing the structure of flow channels inside the head 50 (a plan view perspective diagram in direction A in FIG. 4).

The nozzle pitch in the head 50 should be minimized in order to maximize the density of the dots formed on the surface of the recording paper. As illustrated in FIGS. 3A and 3B, the head 50 according to the present embodiment has a structure in which a plurality of ink chamber units 53, each comprising a nozzle 51 forming an ink droplet ejection hole, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the main scanning direction perpendicular to the paper conveyance direction) is reduced and high nozzle density is achieved.

The mode of forming one or more nozzle rows through a length corresponding to the entire width of the recording paper 16 in a direction substantially perpendicular to the paper conveyance direction is not limited to the example described above. For example, instead of the configuration in FIG. 3A, as illustrated in FIG. 3C, a line head having nozzle rows of a length corresponding to the entire width of the recording paper 16 can be formed by arranging and combining, in a staggered matrix, short head blocks (head chips) 50' having a plurality of nozzles 51 arrayed in a two-dimensional fashion. Furthermore, although not shown in the drawings, it is also possible to compose a line head by arranging short heads in one row.

The pressure chambers 52 provided corresponding to the respective nozzles 51 are approximately square-shaped in planar form, and a nozzle 51 and an ink inlet port 54 are provided respectively at either corner of a diagonal of each pressure chamber 52. Each pressure chamber 52 is connected via the ink inlet port 54 to a common flow channel 55. Furthermore, a nozzle flow channel 60 connected to each of the pressure chambers 52 is connected via an individual flow channel 62 to a common circulation flow channel 64. A supply port 66 and an outlet port 68 are provided in the head 50, the supply port 66 is connected to the common flow channel 55, and the outlet port 68 is connected to the common circulation flow channel 64.

In other words, the supply port 66 and the outlet port 68 of the head 50 are composed so as to be connected via an ink flow channel (which corresponds to the "internal flow channel" of embodiments of the present invention) which includes the common flow channel 55, the ink inlet ports 54, the pressure chambers 52, the nozzle flow channels 60, the individual flow channels 62, and the common circulation flow channel 64. Consequently, a portion of the ink which has been supplied to the supply port 66 from outside the head is ejected from the nozzles 51, and the remainder of the ink passes successively via the common flow channel 55, the nozzle flow channels 60, the individual flow channels 62 and the common circulation flow channel 64 (in other words, it is circulated via the internal ink flow channel of the head) and then output to the exterior of the head from the outlet port 68.

As illustrated in FIG. 4, a desirable composition is one in which the individual flow channels 62 are connected to the nozzle flow channels 60 in the vicinity of the nozzles 51, and therefore since the ink is allowed to circulate in the vicinity of the nozzles 51, increase in the viscosity of the ink inside the nozzle 51 is prevented and stable ejection can be achieved.

Piezoelectric elements 58 respectively provided with individual electrodes 57 are bonded to a diaphragm 56 which forms the upper face of the pressure chambers 52 and also serves as a common electrode, and each piezoelectric element 58 is deformed when a drive voltage is supplied to the corresponding individual electrode 57, thereby causing ink to be ejected from the corresponding nozzle 51. When ink is ejected, new ink is supplied to the pressure chambers 52 from the common flow channel 55, via the ink inlet ports 54.

In the present example, a piezoelectric element 58 is used as an ink ejection force generating device which causes ink to be ejected from a nozzle 50 provided in a head 51, but it is also possible to employ a thermal method in which a heater is provided inside the pressure chamber 52 and ink is ejected by using the pressure of the film boiling action caused by the heating action of this heater.

As illustrated in FIG. 3B, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is $d \times \cos\theta$, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

When implementing the present invention, the arrangement structure of the nozzles is not limited to the example shown in the drawings, and it is also possible to apply various other types of nozzle arrangements, such as an arrangement structure having one nozzle row in the sub-scanning direction.

Furthermore, the scope of application of the present invention is not limited to a printing system based on a line type of head, and it is also possible to adopt a serial system where a short head which is shorter than the breadthways dimension of the recording paper 16 is scanned in the breadthways direction (main scanning direction) of the recording paper 16, thereby performing printing in the breadthways direction, and when one printing action in the breadthways direction has been completed, the recording paper 16 is moved through a prescribed amount in the direction perpendicular to the breadthways direction (the sub-scanning direction), printing in the breadthways direction of the recording paper 16 is carried out in the next printing region, and by repeating this sequence, printing is performed over the whole surface of the printing region of the recording paper 16.

Configuration of Control System

Figure 6:
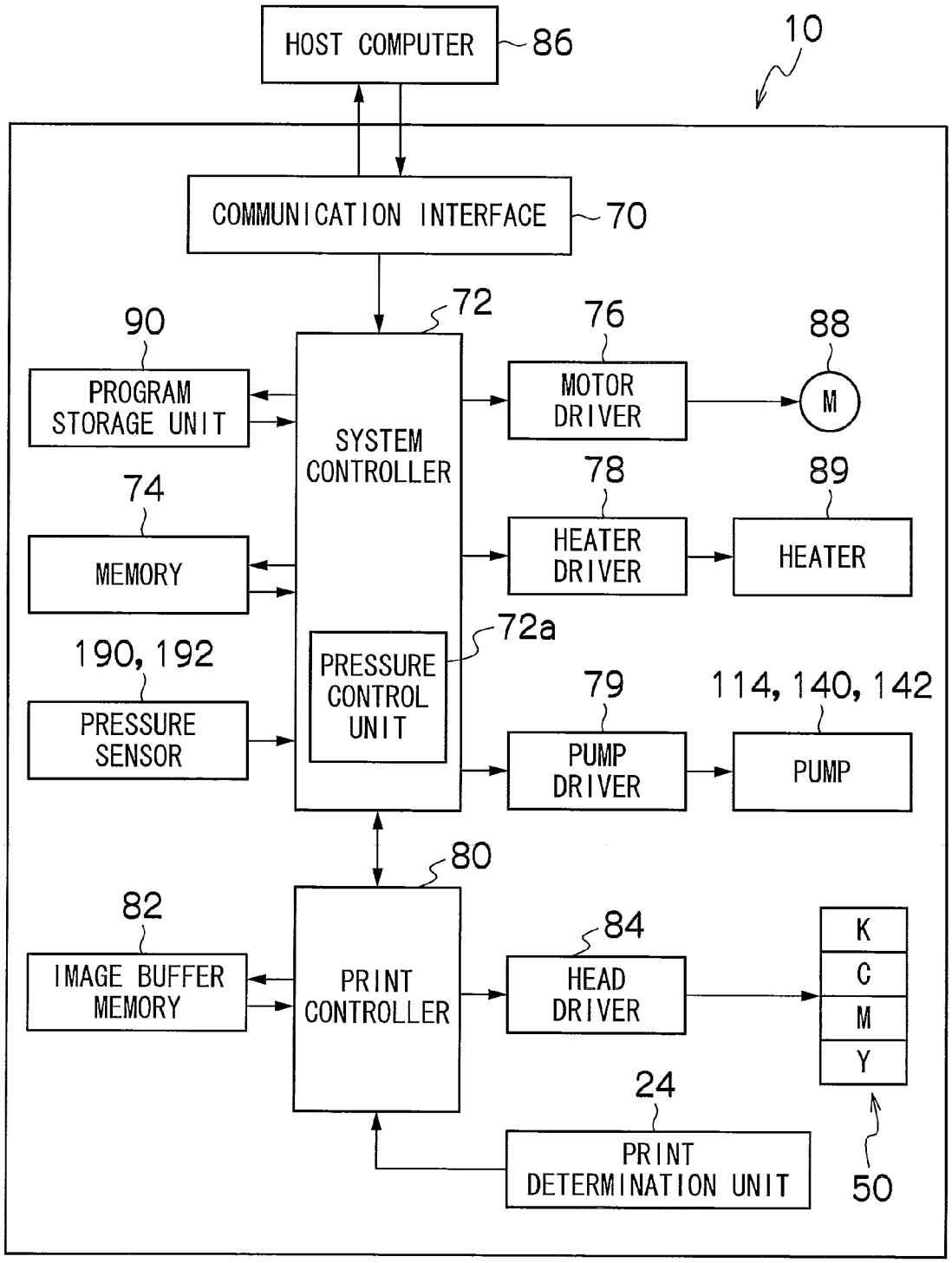
FIG. 6 is a principal block diagram showing the control system of an inkjet recording apparatus.

FIG. 6 is a principal block diagram showing the control system of the inkjet recording apparatus 10. The inkjet recording apparatus 10 comprises a communication interface 70, a system controller 72, a memory 74, a motor driver 76, a heater driver 78, a print controller 80, an image buffer memory 82, a head driver 84, and the like.

The communication interface 70 is an interface unit for receiving image data sent from a host computer 86. A serial interface such as USB (Universal Serial Bus), IEEE1394, Ethernet®, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the memory 74. The memory 74 is a storage device for temporarily storing images inputted through the communication interface 70, and data is written and read to and from the memory 74 through the system controller 72. The memory 74 is not limited to a memory composed of semiconductor elements, and a hard disk drive or another magnetic medium may be used.

The system controller 72 is a control unit which controls the respective sections, such as the communication interface 70, the memory 74, the motor driver 76, the heater driver 78, and the like. The system controller 72 is made up of a central processing unit (CPU) and peripheral circuits thereof, and as well as controlling communications with the host computer 86 and controlling reading from and writing to the memory 74, and the like, and it generates control signals for controlling the motors 88 of the conveyance system and the heaters 89.

This system controller 72 includes a pressure control unit 72*a*. As described below with reference to FIGS. 7 to 9, the pressure control unit 72*a* controls the driving of pumps 140 and 142 in accordance with the determination results of pressure sensors 190 and 192 (i.e., the internal pressures of liquid chambers 122 and 132 of sub tanks 120 and 130, respectively), and by moving the ink between the liquid chamber 122 of the sub tank 120, the liquid chamber 132 of the sub tank 130, and the buffer tanks 102, pressure control is implemented in such a manner that the internal pressures of the liquid chambers 122 and 132 remains constant at the target pressures.

Programs executed by the CPU of the system controller 72 and the various types of data which are required for control procedures are stored in the memory 74. The memory 74 may be a non-writeable storage device, or it may be a rewriteable storage device, such as an EEPROM. The memory 74 is used as a temporary storage region for the image data, and it is also used as a program development region and a calculation work region for the CPU.

Various control programs are stored in the program storage unit 90, and the control programs are read out and executed in accordance with commands from the system controller 72. The program storage unit 90 may use a semiconductor memory, such as a ROM, EEPROM, or a magnetic disk, or the like. An external interface may be provided, and a memory card or PC card may also be used. Naturally, a plurality of these recording media may also be provided. The program storage unit 90 may also be combined with a storage device for storing operational parameters, and the like (not illustrated).

The motor driver (drive circuit) 76 drives the motor 88 in accordance with commands from the system controller 72. The heater driver 78 drives the heater 89 of the post-drying unit 42 and the like in accordance with commands from the system controller 72.

The pump driver 79 is a driver which drives the pumps 114, 142 and 152 of the ink supply system in accordance with instructions from the system controller 72.

The print controller 80 has a signal processing function for performing various tasks, compensations, and other types of processing for generating print control signals from the image data stored in the memory 74 in accordance with commands from the system controller 72 so as to supply the generated print control signals (dot data) to the head driver 84. Necessary signal processing is carried out in the print controller 80, and the ejection amount and the ejection timing of the ink from the respective recording heads 50 are controlled via the head driver 84, on the basis of the print data. By this means, desired dot size and dot positions can be achieved.

The print controller 80 is provided with the image buffer memory 82; and image data, parameters, and other data are temporarily stored in the image buffer memory 82 when image data is processed in the print controller 80. The aspect illustrated in FIG. 6 is one in which the image buffer memory 82 accompanies the print controller 80; however, the memory 74 may also serve as the image buffer memory 82. Also possible is an aspect in which the print controller 80 and the system controller 72 are integrated to form a single processor.

The head driver 84 generates drive signals for driving the piezoelectric elements 58 (see FIG. 4) of the recording heads 50 of the respective colors, on the basis of dot data supplied from the print controller 80, and supplies the generated drive signals to the piezoelectric elements 58. A feedback control system for maintaining constant drive conditions in the recording heads 50 may be included in the head driver 84.

The print determination unit 24 is a block that includes the line sensor as described above with reference to FIG. 1, reads the image printed on the recording paper 16, determines the print conditions (presence of the ejection, variation in the dot formation, and the like) by performing prescribed signal processing, and the like, and provides the determination results of the print conditions to the print controller 80. According to requirements, the print controller 80 makes various corrections with respect to the recording head 50 on the basis of information obtained from the print determination unit 24.

Composition of Ink Supply System

Next, the composition of an ink supply system (ink supply apparatus) of the inkjet recording apparatus 10 which is the characteristic portion of the present invention (first to third embodiments) will be described.

First Embodiment

Figure 7:
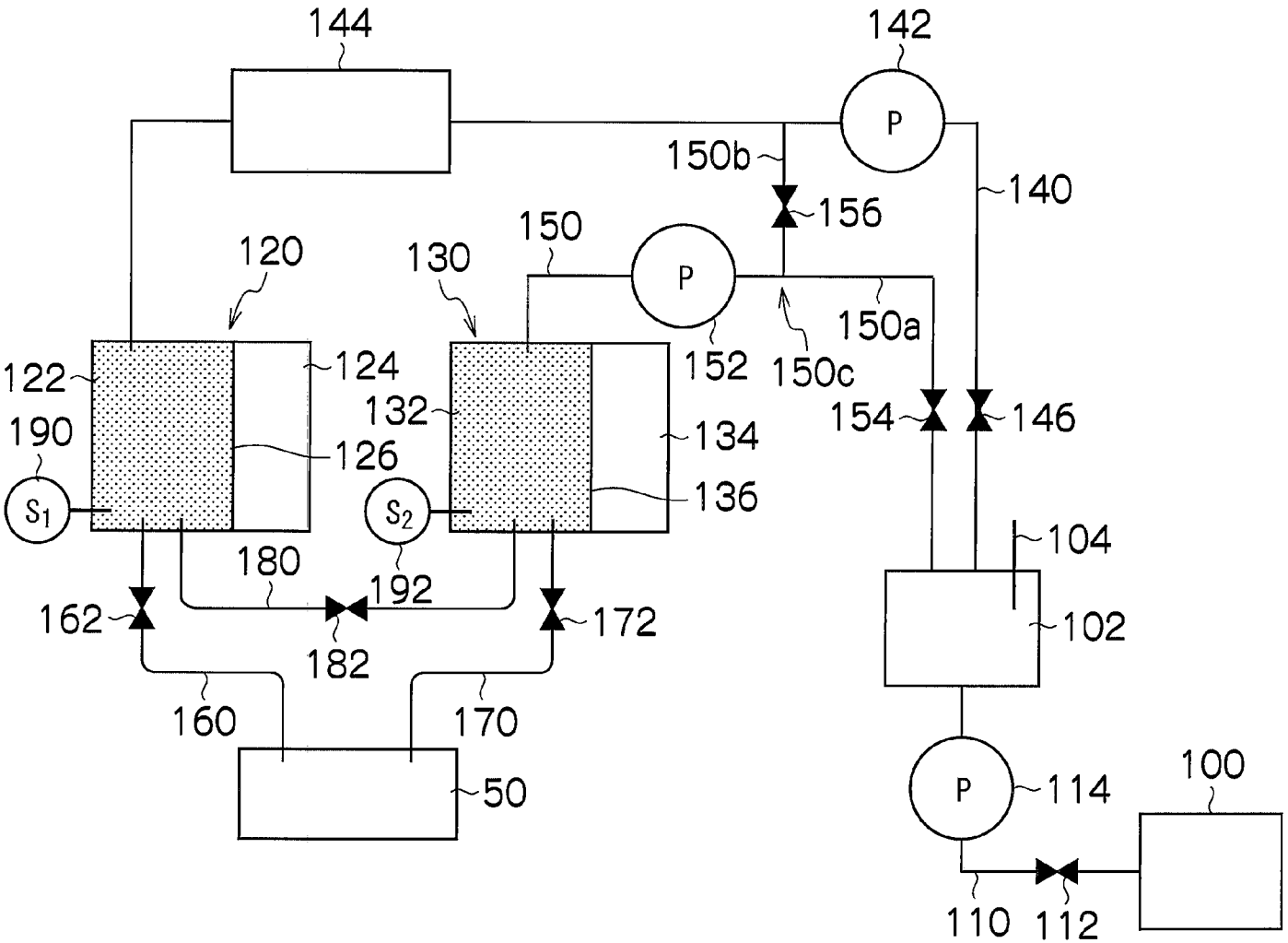
FIG. 7 is a schematic drawing showing the composition of an ink supply system according to a first embodiment.

FIG. 7 is a schematic drawing showing the composition of an ink supply system according to a first embodiment of the present invention. In FIG. 7, in order to simplify the description, the ink supply system relating to only one color is depicted, but in the case of a plurality of colors, a plurality of similar compositions are provided.

As shown in FIG. 7, the ink supply system in the first embodiment principally includes: a main tank 100, a buffer tank 102, a supply sub tank 120 and a recovery sub tank 130.

The main tank 100 is a base tank (ink supply source) which stores the ink for supplying to the head 50, and corresponds to the tank that is disposed in the ink storage and loading unit 14 shown in FIG. 1. One end of a flow channel 110 is connected to the main tank 100, and the other end of the flow channel 110 is connected to the buffer tank 102. In this flow channel 110, an opening and closing valve 112 and a pump 114 are provided in sequence from the upstream side in terms of the direction of ink supply (the direction from the main tank 100 toward the buffer tank 102). Consequently, it is possible to supply the ink from the main tank 100 to the buffer tank 102 in accordance with the driving of the pump 114. Furthermore, by controlling the opening and closing valve 112, it is possible to control the ink volume flowing in the flow channel 110 (in other words, the volume of the ink supplied from the main tank 100 to the buffer tank 102). Moreover, when the main tank 100 is replaced with a new one, it is possible to prevent leaking of the ink by closing the opening and closing valve 112 completely so as to shut off the flow channel 110.

The buffer tank 102 functions as a liquid storage unit (liquid buffer chamber) which temporarily stores the ink supplied from the main tank 100. An air connection port 104 is provided in the buffer tank 102 and the interior of the buffer tank 102 is thereby connected to the outside air. As described below, when the pressure control unit 72*a* shown in FIG. 6 implements pressure control, it is possible to control the internal pressures of the liquid chambers 122 and 132 of the respective sub tanks 120 and 130, independently, without the ink that has flowed out from the liquid chambers 122 and 132 of the sub tanks 120 and 130 to the buffer tank 102 being left in a dead-end state.

Furthermore, a liquid surface sensor (not shown) is provided in the buffer tank 102. If the liquid surface sensor determines that the ink inside the buffer tank 102 is at or below a predetermined standard value, then the system controller 72 shown in FIG. 6 controls the driving of the pump 114 through the pump driver 79, thereby implementing the supply of the ink from the main tank 100 to the buffer tank 102.

The supply sub tank 120 which temporarily holds the ink supplied from the buffer tank 102 is provided at an intermediate position in the supply flow channels (140, 160) which serve to supply the ink inside the buffer tank 102 to the head 50.

The recovery sub tank 130 which temporarily holds the ink recovered from the head 50 is provided at an intermediate position of the recovery flow channels (170, 150) which serve to return the ink that has been circulated inside the head 50 to the flow channel 140 that forms a portion of the supply flow channel.

The supply sub tank 120 and the recovery sub tank 130 are disposed vertically above the head 50 (and desirably in close proximity to the head). The sub tanks 120 and 130 each have the same composition, in which the interior of a hermetically sealed container is divided into two spaces by means of a flexible film. More specifically, a liquid chamber 122 and a gas chamber 124 are formed on either side of a flexible film 126 inside the supply sub tank (sealed container) 120. Similarly, a liquid chamber 132 and a gas chamber 134 are formed on either side of a flexible film 136 inside the recovery sub tank (sealed container) 130. Of course, in implementing the present invention, it is not absolutely necessary for the sub tanks 120 and 130 to have the same composition, and they may adopt different compositions.

In the present embodiment, desirably, the flexible films 126 and 136 which form the sub tanks 120 and 130 are constituted by elastic films (made of rubber, for instance). It is possible to attenuate sudden pressure variation caused by the pumps 142 and 152 and the ejection of the ink by the head 50, by means of the elastic force of the elastic film and suitable elastic force created by the compressive properties of the gas chamber. In the present embodiment, air is filled in the gas chambers 124 and 134, but the invention is not limited to this and a gas other than air may also be filled in the gas chambers 124 and 134.

One end of the flow channel 140 is connected to the liquid chamber 122 of the supply sub tank 120 and the other end of the flow channel 140 is connected to the buffer tank 102. In this flow channel 140, an opening and closing valve 146, a pump 142 and a deaeration device 144 are provided in sequence from the upstream side in terms of the direction of ink supply (the direction from the buffer tank 102 toward the supply sub tank 120).

Furthermore, one end of the flow channel 150 is connected to the liquid chamber 132 of the recovery sub tank 130 and the other end of the flow channel 150 branches into two flow channels 150*a* and 150*b*; one flow channel (first branch flow channel) 150*a* is connected to the buffer tank 102 and the other flow channel (second branch flow channel) 150*b* is connected to an intermediate point of the flow channel 140 in the portion between the pump 142 and the deaeration apparatus 144. A pump 152 is provided in the flow channel 150, on the side toward the recovery sub tank 130 from the branching section 150*c* of the first and second branch flow channels 150*a* and 150*b*, and furthermore, opening and closing valves 154 and 156 are provided respectively in the first and second branch flow channels 150*a* and 150*b*.

The pumps 142 and 152 are each pumps which can be driven in the forward and reverse directions, and function as liquid movement devices which are capable of moving the ink respectively in either direction between the liquid chamber 122 of the supply sub tank 120, the liquid chamber 132 of the recovery sub tank 130, and the buffer tank 102.

As stated previously, the pressure control unit 72*a* shown in FIG. 6 controls the internal pressures of the liquid chambers 122 and 132 of the sub tanks 120 and 130, by controlling the driving of the pumps 142 and 152. In this case, since the interior of the buffer tank 102 is connected to the air, then when the internal pressures of the liquid chambers 122 and 132 of the sub tanks 120 and 130 are controlled by means of driving the pumps 142 and 152, it is possible to control the internal pressures of the liquid chambers 122 and 132 of the sub tanks 120 and 130, independently, without the ink flowing out from the liquid chambers 122 and 132 of the sub tanks 120 and 130 to the buffer tank 102 ending up in a dead-end state.

When the ink is moved between the buffer tank 102, the liquid chamber 122 of the supply sub tank 120 and the liquid chamber 132 of the recovery sub tank 130, by driving the pumps 142 and 152, the flexible films (desirably, elastic films) 126 and 136 of the sub tanks 120 and 130 and the gas chambers 124 and 134 function as dampers which attenuate the pressure variations caused by the pumps 142 and 152. Thereby, it is possible to prevent pressure variations from being transmitted to the head 50, and good print quality can be maintained. Moreover, it is also possible to control ink circulation at a very slow flow speed.

The deaeration device 144 removes dissolved gas from the ink, and includes a bundle of hollow fibers (not shown) composed of PTFE (polytetrafluoroethylene) tubes or silicone tubes through which the ink is passed; the gas dissolved in the ink can be separated and removed by reducing the pressure and deaerating the area peripheral to the fiber bundle by means of a vacuum pump (not shown). The ink deaeration method employed in the deaeration device 144 can employ a commonly known technique, such as the vacuum (reduced pressure deaeration) method described above, or it may also employ method of various types, such as an ultrasonic vibration method or centrifugal separation method, or the like.

Desirably, a filter (not shown) is provided between the deaeration device 144 and the connection of the flow channel 140 with the second branch flow channel 150*b*. By disposing the filter on the upstream side from the deaeration device 144 in terms of the ink supply direction (the direction from the buffer tank 102 toward the supply sub tank 120), the ink in a good state from which foreign matter has been removed by the filter is introduced into the deaeration device 144, and therefore it is possible to prevent blockages in the deaeration device 144 and to extend the life of the device. Furthermore, it is also possible to remove foreign matter contained in the ink supplied from the buffer tank 102 to the liquid chamber 122 of the supply sub tank 120 and the ink which is supplied back to the liquid chamber 122 of the sub tank 120 from the head 50 through the liquid chamber 132 of the recovery sub tank 130, and therefore ejection defects caused by foreign matter can be prevented.

One end of a flow channel 160 is connected to the liquid chamber 122 of the supply sub tank 120, and the other end of the flow channel 160 is connected to the supply port 66 of the head 50 (see FIGS. 4 and 5). Similarly, one end of a flow channel 170 is connected to the liquid chamber 132 of the recovery sub tank 130, and the other end of the flow channel 170 is connected to the outlet port 68 of the head 50 (see FIGS. 4 and 5).

Opening and closing valves 162 and 172 are provided respectively in the flow channels 160 and 170. The opening and closing valve 162 is a valve which controls the ink circulation volume (ink supply volume) from the liquid chamber 122 of the supply sub tank 120 toward the head 50, by being opened and closed. The opening and closing valve 172 is a valve which controls the ink circulation volume (ink recovery volume) from the head 50 toward the liquid chamber 132 of the recovery sub tank 130, by being opened and closed.

Moreover, one end of a bypass flow channel 180 is connected to the liquid chamber 122 of the supply sub tank 120, and the other end of the bypass flow channel 180 is connected to the liquid chamber 132 of the recovery sub tank 130. An opening and closing valve 182 is provided in the bypass flow channel 180, and by means of opening and closing, this valve 182 controls the ink circulation volume from the liquid chamber 122 of the supply sub tank 120 through the bypass flow channel 180 to the liquid chamber 132 of the recovery sub tank 130.

Pressure sensors 190 and 192 are provided respectively in the sub tanks 120 and 130. The pressure sensors 190 and 192 function as pressure determination devices which respectively determine the internal pressures of the liquid chambers 122 and 132 of the sub tanks 120 and 130, and these determination results (in other words, the internal pressures of the liquid chambers 122 and 132) are notified to the pressure control unit 72*a* (see FIG. 6).

While the head 50 is performing an ink ejection operation, the pressure control unit 72*a* controls the driving of the pumps 142 and 152 through the pump driver 79 (see FIG. 6) in accordance with the determination results of the pressure sensors 190 and 192. In this case, the valves 146, 156, 162 and 172 are set to an opened state and the valves 154 and 182 are set to a closed state. The valve 182 does not necessarily have to be closed, and may be opened or closed, or adjust the flow rate in accordance with the measurement value of the amount of dissolved oxygen, for example.

More specifically, the pressure control unit 72*a* sets target pressures for the liquid chambers 122 and 132 of the sub tanks 120 and 130 in such a manner that a prescribed back pressure (negative pressure) is applied to the ink inside the head 50 while a prescribed pressure differential is provided between the liquid chambers 122 and 132 of the sub tanks 120 and 130, and the pressure control unit 72*a* controls the internal pressures of the liquid chambers 122 and 132 respectively in accordance with the determination results of the corresponding pressure sensors 190 and 192 in such a manner that the internal pressures of the liquid chambers 122 and 132 of the sub tanks 120 and 130 are kept constantly at the target pressures.

To give a more detailed description, the pressure control unit 72*a* sets the target pressures of the liquid chambers 122 and 132 in such a manner that an ink meniscus is maintained in each of the nozzles 51 of the head 50 and the internal pressure of the liquid chamber 122 of the supply sub tank 120 is relatively higher than the internal pressure of the liquid chamber 132 of the recovery sub tank 130, and drives the pumps 142 and 152 respectively on the basis of the determination results of the pressure sensors 190 and 192 so as to control the pressures in such a manner that the internal pressures of the liquid chambers 122 and 132 are kept constantly at the target pressures by moving the ink between the liquid chambers 122 and 132 of the sub tanks 120 and 130, and the buffer tank 102.

In this case, the pressure differential between the liquid chambers 122 and 132 of the sub tanks 120 and 130 is set so as to satisfy the following conditions. More specifically, in the embodiment shown in FIG. 7, taking the target pressure of the liquid chamber 122 of the supply sub tank 120 as $P_{in}$, taking the target pressure of the liquid chamber 132 of the recovery sub tank 130 as $P_{out}$, taking the back pressure of the ink inside the nozzles 51 of the head 50 as $P_{nzl}$, and taking the pressure differential based on the height difference H between the liquid chambers 122 and 132 and the nozzle surface (ink ejection surface) of the head 50 as $\Delta P_h$, then the pressure is controlled so as to satisfy the following relationship:

$$P_{in}+\Delta P_h>P_{nzl}>P_{out}+\Delta P_h. \quad (1)$$

Furthermore, Expression (1) may also be written in the following form, if "$mmH_2O$" is used as the unit of pressure:

$$P_{in}+H>P_{nzl}>P_{out}+H. \quad (2)$$

In the embodiment shown in FIG. 7, the liquid chambers 122 and 132 are disposed at the same height, but if they are disposed at different heights, then Expression (1) should be modified in accordance with this height differential. In other words, taking the pressure differential caused by the height difference between the liquid chamber 122 of the supply sub tank 120 and the nozzle surface of the head 50 to be $\Delta P_{h1}$, and taking the pressure differential caused by the height difference between the liquid chamber 132 of the recovery sub tank 130 and the nozzle surface of the head 50 to be $\Delta P_{h2}$, then the pressure is controlled so as to satisfy the following relationship:

$$P_{in}+\Delta P_{h1}>P_{nzl}>P_{out}+\Delta P_{h2}. \quad (3)$$

By means of the pressure control unit 72*a* implementing control whereby the internal pressures of the liquid chambers 122 and 132 of the sub tanks 120 and 130 are kept uniformly at the target pressures, as described above, the ink is circulated continuously at a prescribed speed through the first ink circulation path constituted of the liquid chamber 122 of the supply sub tank 120, the flow channel 160, the head 50, the flow channel 170, the liquid chamber 132 of the recovery sub tank 130, a portion of the flow channel 150 (the portion from the recovery sub tank 130 until the branching section 150*c* of the branch flow channels 150*a* and 150*b*), the second branch flow channel 150*b* and a portion of the flow channel 140 (the portion from the connection with the second branch flow channel 150*b* until the supply sub tank 120), while maintaining the ink meniscus in each nozzle 51 of the head 50.

Hence, it is possible to achieve the back pressure control of high precision, irrespective of the ink consumption (in other words, the print duty) in the head 50. Moreover, since the ink is circulated constantly inside the head 50 (and especially in the vicinity of the nozzles), irrespectively of the ejection state of the head 50, then it is possible to prevent ejection defects caused by increased viscosity of the ink, or the like, and therefore satisfactory print quality can be maintained over a long period of time.

Furthermore, since the deaeration device 144 which is provided in the flow channel 140 that forms a portion of the first ink circulation path, then good ink which has been deaerated by the deaeration device 144 is circulated through the first ink circulation path, and therefore ejection from the head 50 can be stabilized.

However, the ink flow channels inside the head 50 are narrower than the other flow channels (140, 150, 160, 170), the flow channel resistance inside the head 50 is large, and the ink circulation volume in the first ink circulation path is restricted, and hence there are concerns that if the speed at which the dissolved gas in the ink is removed falls below the speed at which gas dissolves into the ink (rate of increase in the dissolved gas), then the ink containing a large amount of dissolved gas will enter into the head 50, leading to ejection defects.

Therefore, in the present embodiment, the bypass flow channel 180 which connects between the liquid chamber 122 of the supply sub tank 120 and the liquid chamber 132 of the recovery sub tank 130 is provided separately from the first ink circulation path which passes through the head 50, in such a manner that the ink is circulated through the second ink circulation path constituted of the liquid chamber 122 of the supply sub tank 120, the bypass flow channel 180, the liquid chamber 132 of the recovery sub tank 130, a portion of the flow channel 150 (the portion from the recovery sub tank 130 until the branching section 150*c* with the respective branch flow channels 150*a* and 150*b*), the second branch flow channel 150*b* and a portion of the flow channel 140 (the portion from the connection with the second branch flow channel 150 until the supply sub tank 120).

Since the pump 152 is provided in the flow channel 150 which constitutes a portion of the second ink circulation path, and since the deaeration device 144 is provided in the flow channel 140, then it is possible to promote the removal of dissolved gas inside the ink by circulating the ink through the second ink circulation path, without the ink passing through the head 50. Thus, it is possible to supply good ink which has been deaerated to the head 50, and therefore ejection stability can be improved.

It is desirable that the circulation of the ink in the first and second ink circulation paths is carried out constantly while the inkjet recording apparatus 10 is switched on. In other words, by implementing control in such a manner that the prescribed pressure differential is maintained between the liquid chamber 122 of the supply sub tank 120 and the liquid chamber 132 of the recovery sub tank 130, the ink can be circulated constantly inside the head 50 (and in particular, in the vicinity of the nozzles) regardless of the ejection status of the head 50 (whether the head is ejecting or not ejecting), and therefore ejection defects caused by increase in the viscosity of the ink, or the like, are prevented and satisfactory printing quality can be maintained over a long period of time. Moreover, it is possible to supply good ink which has been deaerated by means of the second ink circulation path to the head 50, and therefore ejection stability can be improved.

Furthermore, in the inkjet recording apparatus 10, when it is necessary to replenish ink to the liquid chamber 122 of the supply sub tank 120, the ejection operation of the head 50 is halted temporarily, the valve 146 is opened, the valves 154, 156, 162, 172 and 182 are closed, and the pump 142 is driven for a prescribed time in the forward direction (the direction from the buffer tank 102 toward the supply sub tank 120). In this case, the driving of the pump 152 is halted. Thereby, the ink is supplied from the buffer tank 102 to the liquid chamber 122 of the supply sub tank 120. After replenishing the ink, the valves 146, 154, 156, 162, 172 and 182 are returned to their original states and the ejection operation of the head 50 is resumed while controlling the driving of the pumps 142 and 152 as described above.

Furthermore, in a warming up operation after the start-up of the inkjet recording apparatus 10, the valves 156 and 182 are opened, the valves 146, 154, 162 and 172 are closed, and the pump 152 is driven for a prescribed period of time in the forward direction (the direction from the recovery tank 130 toward the branching section 150*c*). In this case, the driving of the pump 142 is halted. Thereby, the ink is circulated through the above-described second ink circulation path. When the warming up operation has been completed in this way, the valves 146, 156, 162 and 172 are opened, the valves 154 and 182 are closed, and control of the driving of the pumps 142 and 152 is started as described above, thus assuming a standby state in which an ejection operation by the head 50 is possible.

A desirable mode is one in which a deaeration level measurement device (dissolved oxygen meter) which measures the deaeration level of the ink is provided in the first ink circulation path (and desirably, between the deaeration device 144 in the flow channel 140 and the supply sub tank 120), and the valve 182 of the bypass flow channel 180 is controlled in accordance with the deaeration level of the ink measured by the deaeration level measurement device. More specifically, if the deaeration level of the ink measured by the deaeration level measurement device is low (in other words, if there is a large amount of dissolved gas in the ink), then the valve 182 is opened and the volume of ink passing through the bypass flow channel 180 is increased, whereas if the deaeration level of the ink is high (in other words, if there is a small amount of dissolved gas in the ink), then the valve 182 is closed and the volume of ink passing through the bypass flow channel 180 is decreased (or the volume of ink is reduced to zero).

Moreover, a desirable mode is one where the valve 182 of the bypass flow channel 180 is controlled in accordance with the ink consumption volume of the head 50 (in other words, the print duty). More specifically, if the ink consumption of the head 50 is high (in other words, if the print duty is high), then the ink circulation volume in the first ink circulation path becomes large, and therefore the valve 182 is closed, thus decreasing the volume of ink passing through the bypass flow channel 180 (or reducing this ink volume to zero), whereas if the ink consumption of the head 50 is low (in other words, if the print quality is low), then the valve 182 is opened, thereby increasing the volume of ink passing through the bypass flow channel 180.

Furthermore, a more desirable mode is one which combines the above-described two modes, and which controls the valve 182 of the bypass flow channel 180 in accordance with both the deaeration level of the ink as measured by the deaeration level measurement device and the ink consumption volume of the head 50 (in other words, the print duty).

As described above, according to the inkjet recording apparatus 10 of the present embodiment, it is possible to circulate the ink from the liquid chamber 122 of the supply sub tank 120 through the head 50 to the liquid chamber 132 of the recovery sub tank 130 (in other words, the ink is circulated in the first ink circulation path), while maintaining the back pressure (negative pressure) of the head 50 by controlling the internal pressures of the liquid chambers 122 and 132 of the sub tanks 120 and 130 so as to produce a prescribed pressure differential, and therefore it is possible to suppress ejection defects caused by increase in the viscosity of the ink in the vicinity of the nozzles. Moreover, by providing the bypass flow channel 180 which connects the liquid chamber 122 of the supply sub tank 120 with the liquid chamber 132 of the recovery sub tank 130, it is possible to circulate the ink inside the liquid chamber 122 of the supply sub tank 120 through the second ink circulation path while performing deaeration of the ink by the deaeration apparatus 144, without passing through the head 50, and therefore it is possible to promote removal of dissolved gas in the ink, independently of the ejection status of the head 50 and the circulated ink volume, and ejection defects caused by the occurrence of gas bubbles can be suppressed. In other words, repeat dissolution of gas is prevented and the ink can be deaerated efficiently. Hence, the ejection stability of the head 50 is improved and images of good quality can be achieved.

Furthermore, according to the present embodiment, since it is possible respectively to control the internal pressures of the liquid chambers 122 and 132 of the sub tanks 120 and 130, then the sub tanks 120 and 130 can also be disposed vertically below the head 50, rather than vertically above the head 50. In other words, there is good freedom of design in terms of the arrangement of the sub tanks 120 and 130 with respect to the head 50, and the apparatus can be made more compact in size.

However, as shown in the present embodiment, a desirable mode is one in which the sub tanks 120 and 130 are disposed in the vicinity of the head 50 directly above same. It is possible to shorten the flow channels 160 and 170 which respectively connect the head 50 with the sub tanks 120 and 130, and therefore it is possible to reduce pressure variations caused by pressure loss in the flow channels 160 and 170, the accuracy of the pressure differential applied between the supply port 66 and the outlet port 68 of the head 50 can be improved and circulation of ink at low speed can be achieved in the vicinity of the nozzles.

Moreover, in the present embodiment, the liquid chamber and the gas chamber are formed on either side of the flexible film, inside each of the sub tanks 120 and 130, but the invention is not limited to this and it is also possible to form only a liquid chamber inside the sub tanks.

In the case of a mode where only a liquid chamber is formed inside the sub tank, desirably, a flexible film (preferably, an elastic film) is provided in a portion of the wall of the sub tank (in between the liquid chamber inside the sub tank and the exterior of the sub tank). However, in cases of this kind, since no elastic force is obtained by the compressive properties of the gas chamber, then although the effect in attenuating sudden pressure variations in the liquid chamber is increased, it is necessary to take account of the decline in the responsiveness of the pressure control caused by the subsidiary pumps. Accordingly, it is desirable to set the elastic force of the flexible film to an appropriate force by altering the elastic force of the flexible film or by providing a spring member which presses the flexible film, or another such method.

Second Embodiment

Next, a second embodiment of the present invention will be described. Below, portions which are common with the first embodiment are not explained further, and the following description centers on the characteristic features of the present embodiment.

Figure 8:
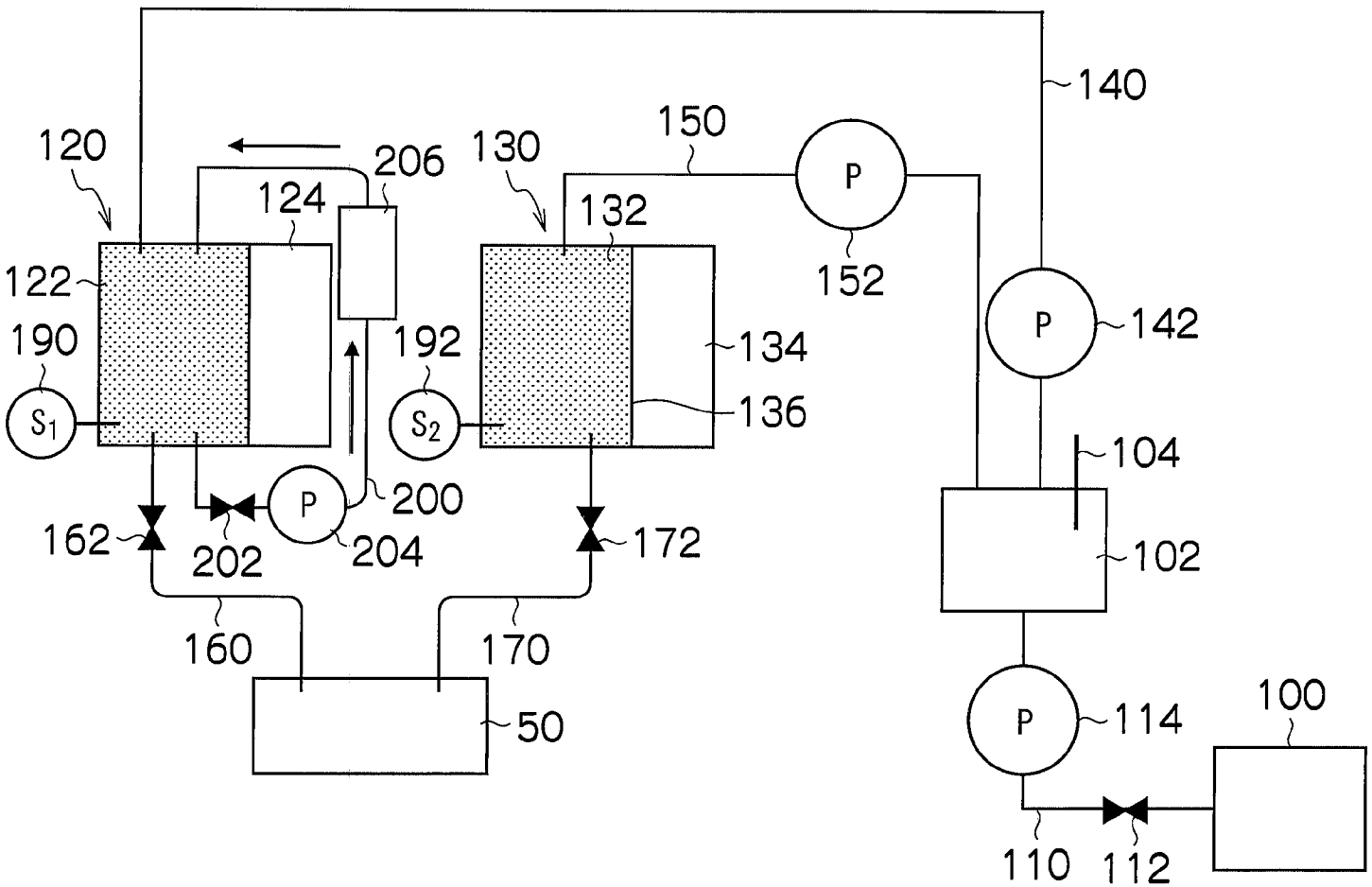
FIG. 8 is a schematic drawing showing the composition of an ink supply system according to a second embodiment.

FIG. 8 is a schematic drawing showing the composition of an ink supply system according to the second embodiment of the present invention. In FIG. 8, parts which are common with FIG. 7 are denoted with the same reference numerals.

In the ink supply system according to the second embodiment, the other end of the flow channel 150 is connected to the buffer tank 102 without branching. In other words, in the second embodiment, a composition is adopted in which the first circulation path includes the buffer tank 102.

Furthermore, in the second embodiment, both ends of a circulation flow channel 200 are connected to the liquid chamber 122 of the supply sub tank 120 as shown in FIG. 8, instead of the bypass flow channel 180 in the first embodiment (see FIG. 7). In the circulation flow channel 200, a valve 202, a pump 204 and a deaeration device 206 are provided in sequence from the upstream side in terms of the ink circulation direction (the direction indicated by arrows in FIG. 8).

The ink can be circulated in the second ink circulation path constituted of the liquid chamber 122 of the supply sub tank 120 and the circulation path 200 by the driving of the pump 204. In this case, since the deaeration device 206 is provided in the circulation flow channel 200, then it is possible to promote the removal of dissolved gas in the ink by means of the deaeration device 206, regardless of the ejection status of the head 50 or the volume of ink circulated. Hence, it becomes possible to supply good ink which has been deaerated to the head 50, and therefore stable ejection performance can be ensured.

In the second embodiment also, similarly to the first embodiment, a desirable mode is one in which the valve 202 of the circulation flow channel 200 is controlled in accordance with the deaeration level of the ink circulating through the first ink circulation channel and the ink consumption volume of the head 50.

Furthermore, in the second embodiment, by disposing the deaeration device 206 separately from the first ink circulation path which is constituted of the liquid chamber 122 of the supply sub tank 120, the flow channel 160, the head 50, the flow channel 170, the liquid chamber 132 of the recovery sub tank 130, the flow channel 150, and a portion of the flow channel 140 (the portion from the connection with the flow channel 150 until the supply sub tank 120), it is possible to reduce pressure loss in the first ink circulation path and the load on the pumps 142 and 152 can be reduced. Consequently, even if using an ink having high viscosity (1 to 10 cP) and a high flow rate (1 to 10 ml/sec), it is possible to control the back pressure with high precision, as well as being able to ensure stable ejection performance, irrespectively of the print duty. Hence, it is possible to improve the ejection reliability of the head 50 and to obtain stable and satisfactory print quality.

Third Embodiment

Next, a third embodiment of the present invention will be described. Below, portions which are common with the first and the second embodiments are not explained further, and the following description centers on the characteristic features of the present embodiment.

Figure 9:
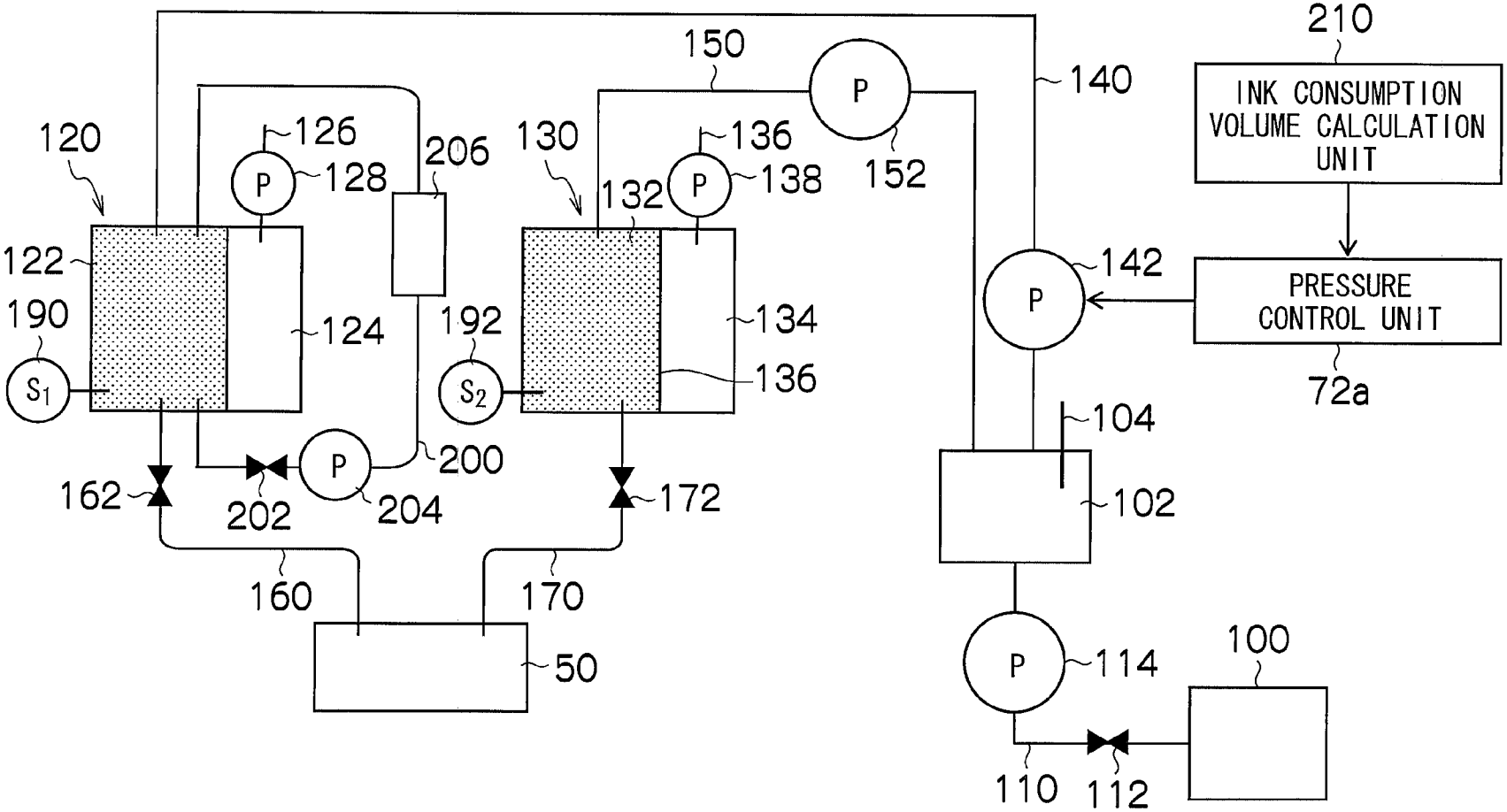
FIG. 9 is a schematic drawing showing the composition of an ink supply system according to a third embodiment.

FIG. 9 is a schematic drawing showing the composition of an ink supply system according to the third embodiment of the present invention. In FIG. 9, parts which are common with FIG. 7 or FIG. 8 are denoted with the same reference numerals.

An ink consumption calculation unit 210 is provided in the ink supply system according to the third embodiment. The ink consumption calculation unit 210 calculates the volume of ink consumed by the head 50 (total ejection volume of the head) on the basis of the image data and the number of prints to be made (print number), and reports the result of this calculation to the pressure control unit 72*a* (see FIG. 6).

The pressure control unit 72*a* controls the driving of the pump 142 in accordance with the ink consumption volume calculated by the ink consumption calculation unit 210, thereby controlling the volume of ink supplied from the buffer tank 102 to the supply sub tank 120.

Furthermore, in the composition shown in FIG. 9, as a composition for adjusting the amount of air in the gas chamber 124 of the supply sub tank 120, a pump 128 is provided in a tube 126, one end of which is connected to the gas chamber 124 and the other end of which is open to the air. Similarly, as a composition for adjusting the amount of air in the gas chamber 134 of the recovery sub tank 130, a pump 138 is provided in a tube 136, one end of which is connected to the gas chamber 134 and the other end of which is open to the air. If the ink volume in the liquid chamber 122 of the supply sub tank 120 is low, for example, then by driving the pump 128 and increasing the amount of air in the gas chamber 124, it is possible to adjust the pressure in the liquid chamber 122 more accurately. The same also applies to the recovery sub tank 130.

Figure 10:
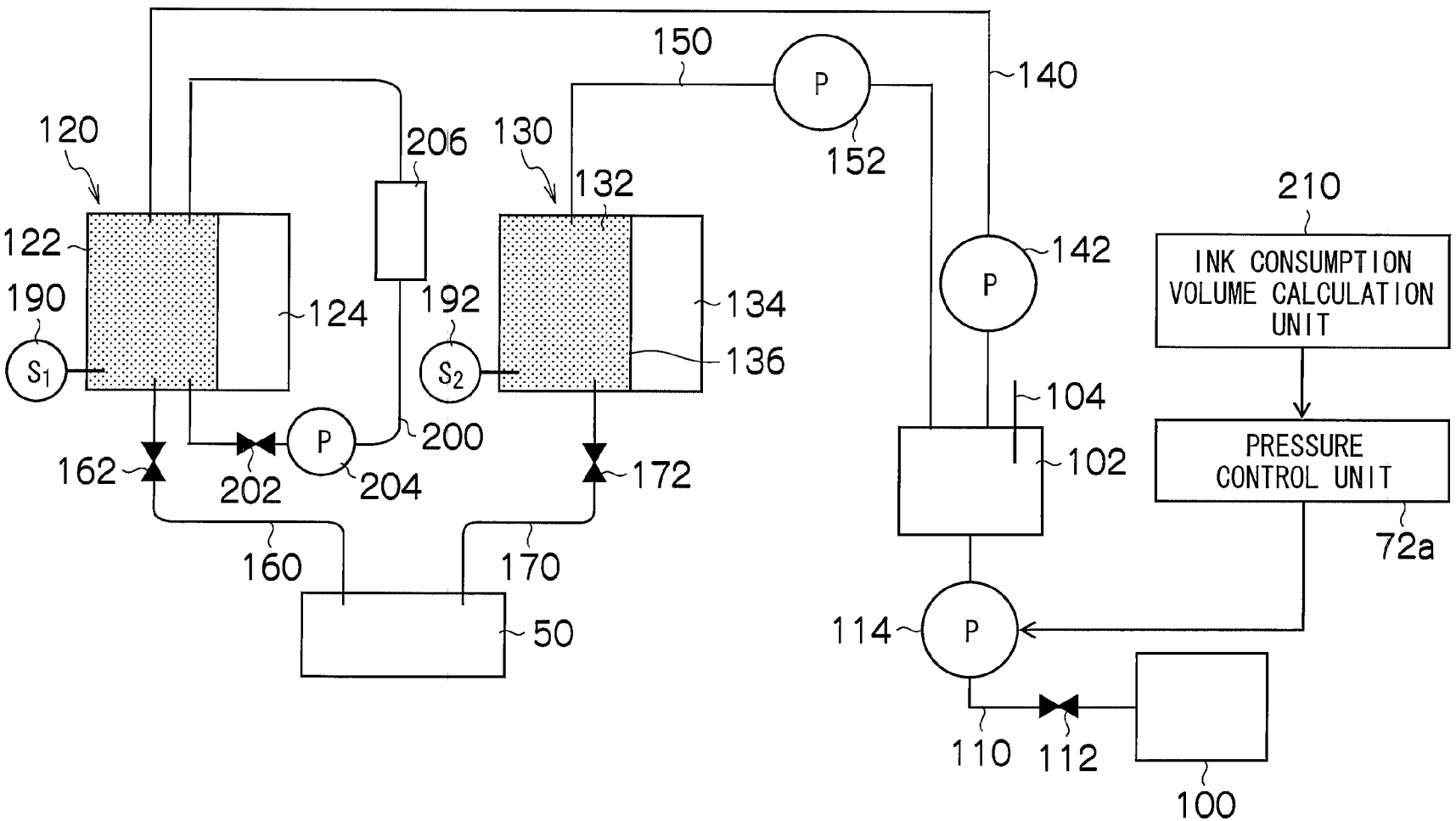
FIG. 10 is a schematic drawing showing the composition of another ink supply system according to the third embodiment.
Figure 11:
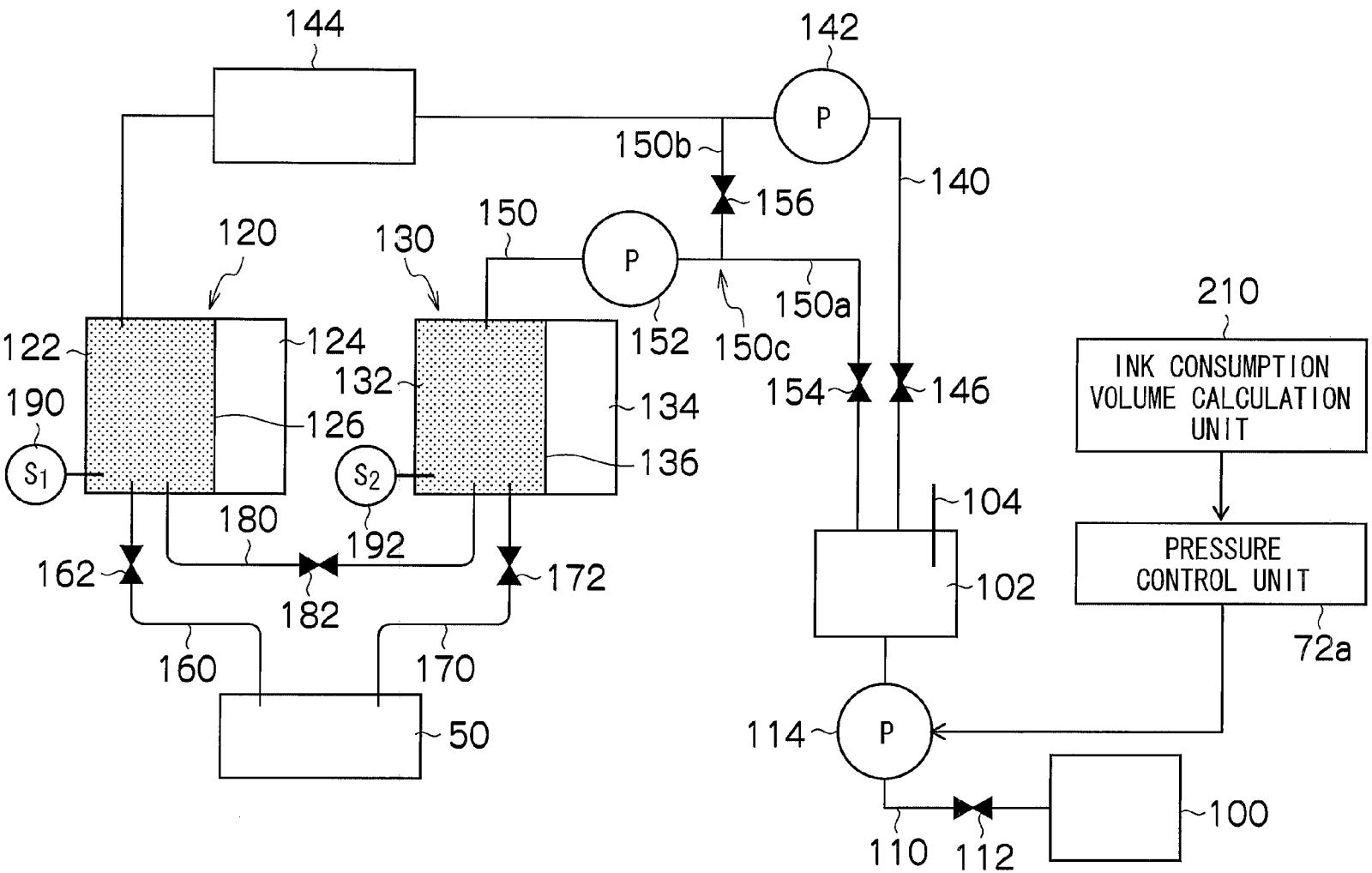
FIG. 11 is a schematic drawing showing the composition of yet another ink supply system according to the third embodiment.

FIGS. 10 and 11 are schematic drawings showing further examples of the compositions of ink supply systems according to the third embodiment. In FIGS. 10 and 11, parts which are common with FIGS. 7 to 9 are denoted with the same reference numerals. In the composition shown in FIGS. 10 and 11, the volume of ink supplied from the main tank 100 to the buffer tank 102 is controlled by controlling the driving of the pump 114, rather than the pump 142, in accordance with the ink consumption volume calculated by the ink consumption calculation unit 210.

Furthermore, a membrane that allows change in volume and does not allow passage between the gas/liquid is provided at the gas/liquid interface in the buffer tank 102 in FIG. 11, and hence it is possible to prevent repeat dissolution of gas in the buffer tank 102.

According to the third embodiment, since the ink is supplied from the buffer tank 102 to the liquid chamber 122 of the supply sub tank 120 in accordance with the ink use volume that is to be consumed by the head 50, on the basis of the image data and the number of prints, then it is possible to shorten the warm up time (preparation time) required for a deaeration process of the ink by circulating the ink in the second ink circulation channel after starting up the apparatus (or after an idle state of the apparatus).

Evaluation Experiments

Next, evaluation experiments relating to the present invention will be described.

In these evaluation experiments, Practical Examples 1 to 3 in which the present invention is applied correspond respectively to the first to third embodiments described above (FIGS. 7 to 9). In other words, in Practical Example 1, an evaluation experiment was carried out using the composition shown in FIG. 7, and similarly, in Practical Example 2 and Practical Example 3, evaluation experiments were carried out using the compositions shown in FIGS. 8 and 9 respectively.

Figure 12:
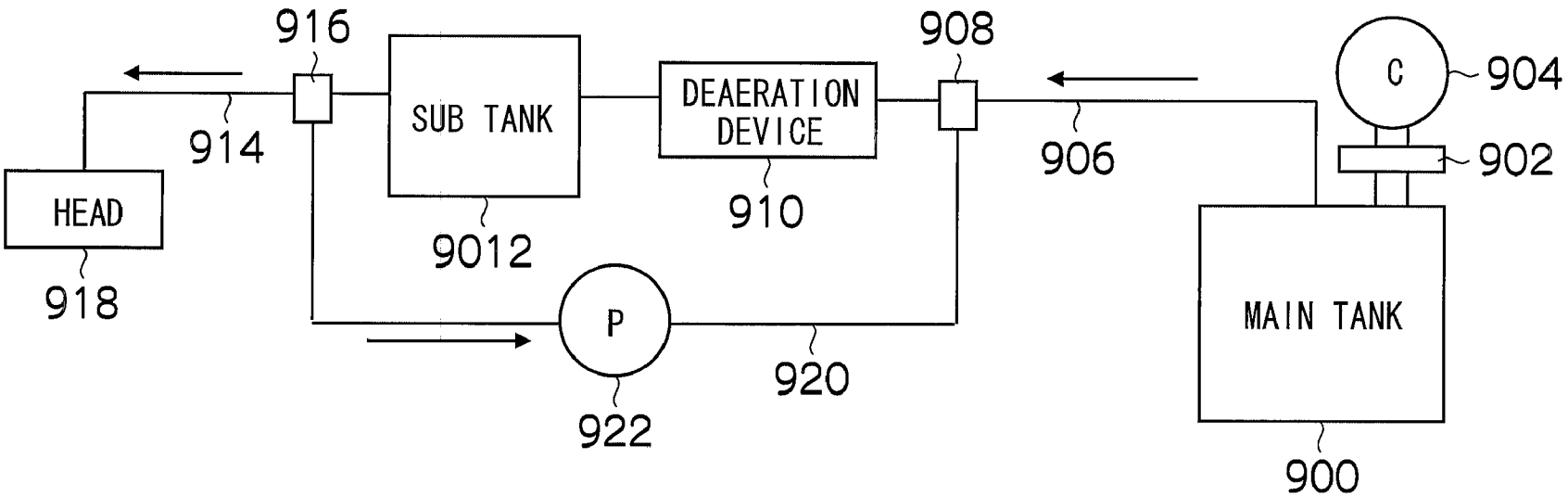
FIG.12 RELATED ART
FIG. 12 is a schematic drawing showing the composition of an ink supply system according to Comparative Example 1.
Figure 13:
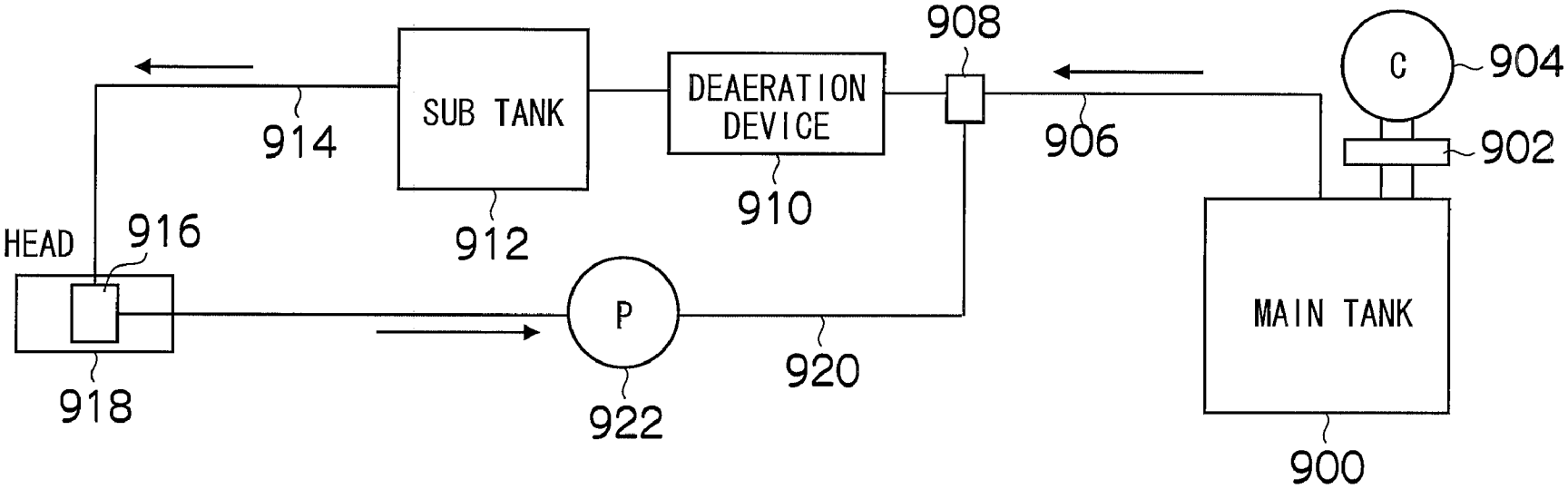
FIG.13 RELATED ART
FIG. 13 is a schematic drawing showing the composition of an ink supply system according to Comparative Example 2.

On the other hand, in Comparative Examples 1 and 2, evaluation experiments were carried out using the compositions described in Japanese Patent Application Publication No. 2005-059476 mentioned above. FIGS. 12 and 13 respectively show the composition of the ink supply system relating to Comparative Examples 1 and 2. In FIGS. 12 and 13, 900 is a main tank, 902 is a regulator, 904 is a compressor, 906 is a flow channel, 908 is a first flow channel switching valve, 910 is a deaeration device, 912 is a sub tank, 914 is a flow channel, 916 is a second flow channel switching valve, 918 is an inkjet head, 920 is a return flow channel, and 922 is a pump. The composition and operation of each unit is as described in Japanese Patent Application Publication No. 2005-059476, and therefore further explanation thereof is omitted here.

Figure 14:
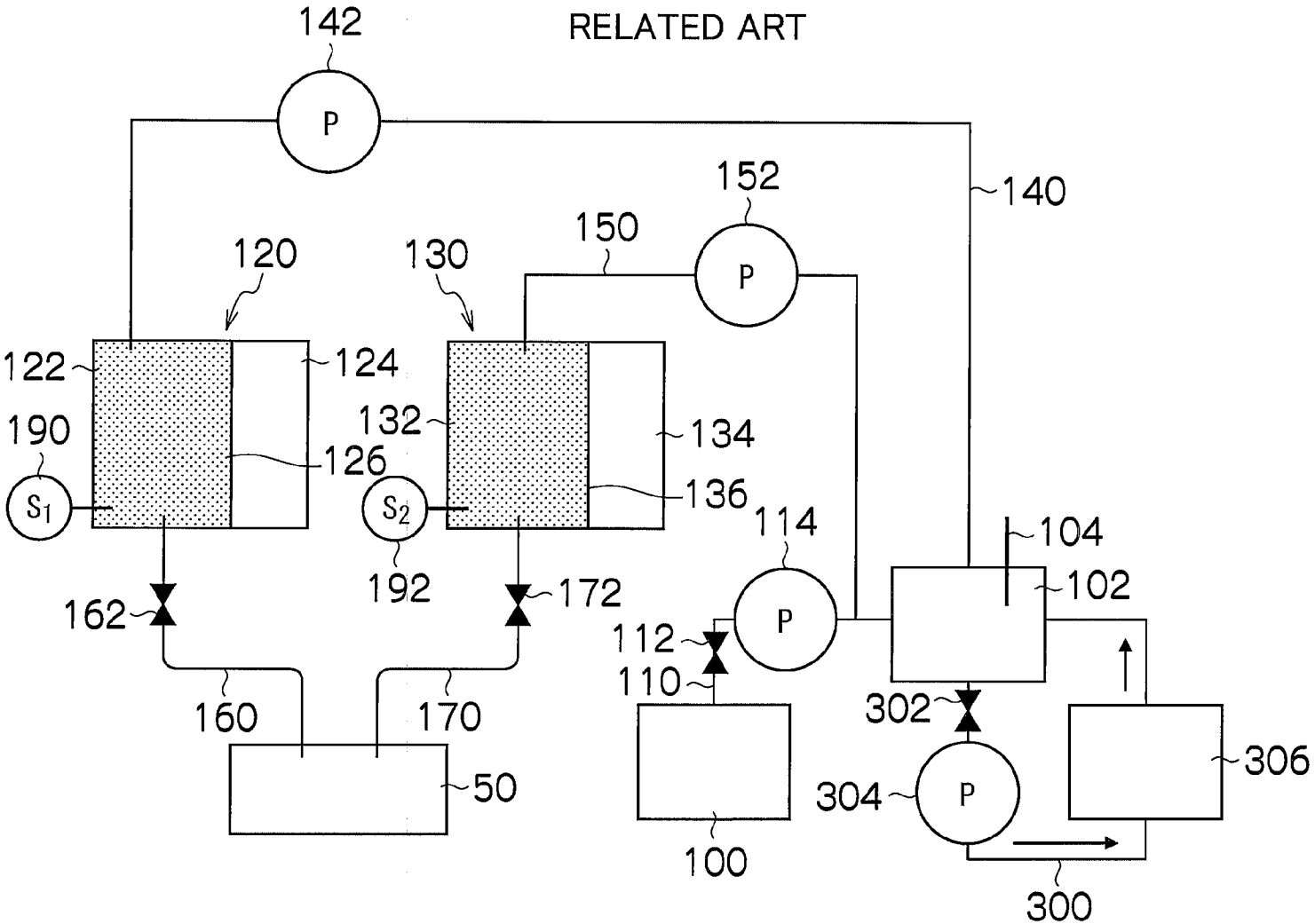
FIG.14 RELATED ART
FIG. 14 is a schematic drawing showing the composition of an ink supply system according to Comparative Example 3.

Furthermore, in Comparative Example 3, an evaluation experiment was carried out using a similar composition to that in the first to third embodiments. FIG. 14 shows the composition of an ink supply system relating to Comparative Example 3. As shown in FIG. 14, in Comparative Example 3, both ends of a circulation flow channel 300 are connected to the buffer tank 102, instead of the circulation flow channel 200 in the second embodiment (see FIG. 8). In the circulation flow channel 300, a valve 302, a pump 304 and a deaeration device 306 are provided in sequence from the upstream side in terms of the ink circulation direction (the direction indicated by arrows in FIG. 14). By circulating the ink inside the buffer tank 102 through the circulation flow channel 300 by driving the pump 304, the dissolved gas in the ink is removed by the deaeration device 306 provided in the circulation flow channel 300. Furthermore, the other end of the flow channel 150 is connected to an intermediate point of the flow channel 110 in the portion between the pump 114 and the buffer tank 102, and ink circulated from the liquid chamber 122 of the supply sub tank 120 through the head 50 to the liquid chamber 132 of the recovery sub tank 130 is returned to the buffer tank 102 through the flow channel 150 and then supplied again from the buffer tank 102 to the liquid chamber 122 of the supply sub tank 120.

FIG. 15 shows the amount of dissolved oxygen in the ink when the ink was circulated in the respective ink circulation channels and the rate of nozzles suffering ejection failure after performing continuous ejection for one hour, in each of Practical Examples 1 to 3 and Comparative Examples 1 to 3 composed as described above. The amount of dissolved oxygen was measured by ejecting ink forcibly from the inkjet head by pressure-applied purging and using a dissolved oxygen meter DO-24P and OE-741A electrode of To a DKK.

As the evaluation results shown in FIG. 15 reveal, in the Practical Examples 1 to 3 in which the present invention is applied, the amount of dissolved oxygen after circulation of ink was lower (10 to 20%) than in Comparative Examples 1 to 3, increase in the viscosity of the ink in the vicinity of the nozzles (ejection ports) was not observed, and there were virtually no nozzles suffering ejection failure after continuous ejection for one hour (ejection failure nozzle rate of less than 1%). Furthermore, the warm up time after start-up of the apparatus (the time period until the amount of dissolved oxygen in the ink became a normal level due to circulation of the ink) was a short time (10 to 20 minutes).

On the other hand, in Comparative Example 1, as shown in FIG. 12, deaeration of the ink supplied to the head 918 is not possible and ink can not be circulated in the vicinity of the ejection ports, meaning that there is no improvement in ejection defects caused by increase in the viscosity of the ink.

In Comparative Example 2, as shown in FIG. 13, a sufficient circulation volume cannot be obtained due to the flow channel resistance in the head 918, and gas dissolves into the ink in the sub tank 912. As a result of this, as shown in FIG. 15, among Comparative Examples 1 to 3, the worst results were obtained in Comparative Example 2, where the amount of dissolved oxygen was extremely high (40 to 70%), the number of nozzles suffering ejection failure after continuous ejection for one hour was high (an ejection failure nozzle rate of 8%), and the warm up time was long (40 to 60 minutes).

In Comparative Example 3, since the buffer tank 102 is open to the air, then gas is liable to dissolve again into the ink. Therefore, although the amount of dissolved oxygen and the ejection failure nozzle rate after one hour was of a similar level to Comparative Example 1, it took a long time to carry out deaeration of the ink inside the buffer tank 102, and the warm up time was long (40 minutes).

As described above, according to the first to third embodiments in which the present invention is applied, since it is possible to prepare ink having a low amount of dissolved gas in a short time, and since it is possible to supply the ink having a low amount of dissolved gas to the recording head (inkjet head) at all times during ejection, then the occurrence of ejection defects caused by gas bubbles can be reduced. Furthermore, since the ink is circulated through the recording head (and desirably in the vicinity of the nozzles), then it is possible to suppress ejection defects caused by increase in the viscosity of the ink in the vicinity of the nozzles (ejection ports).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

a tank inside which liquid is stored;

a first flow channel through which the liquid inside the tank is supplied to an inkjet head;

a first liquid chamber which is provided at an intermediate point of the first flow channel and which temporarily holds the liquid supplied from the tank;

a second flow channel through which the ink circulated inside the inkjet head is returned to at least one of the tank and the first flow channel;

a second liquid chamber which is provided at an intermediate point of the second flow channel and which temporarily holds the liquid recovered from the inkjet head;

a first liquid movement device which is provided at the intermediate point of the first flow channel;

a second liquid movement device which is provided at the intermediate point of the second flow channel;

a first pressure determination device which determines an internal pressure of the first liquid chamber;

a second pressure determination device which determines an internal pressure of the second liquid chamber;

a pressure control device which sets respective target pressures for the first and second liquid chambers in such a manner that while a prescribed back pressure is applied to the liquid inside nozzles of the inkjet head, a prescribed pressure differential is provided between the first and second liquid chambers, and which controls pressures in the first and second liquid chambers by respectively controlling the first and second liquid movement devices, in accordance with determination results of the first and second pressure determination devices, in such a manner that the internal pressures of the first and second liquid chambers respectively remain at the target pressures;

a circulation path through which the liquid inside the first liquid chamber is circulated without passing through the inkjet head;

a deaeration device which is provided at an intermediate point of the circulation path and which removes dissolved gas in the liquid, wherein the circulation path is provided with at least one of a third liquid movement device and the first and second liquid movement devices; and a third flow channel of which one end is connected to the first liquid chamber and the other end is connected to the second liquid chamber, wherein the circulation path includes the third flow channel.

2. The inkjet recording apparatus as defined in claim 1, wherein the deaeration device is provided at an intermediate point of the first flow channel between a point of connection with the second flow channel and the first liquid chamber.

3. The inkjet recording apparatus as defined in claim 2, further comprising:

a dissolved gas amount measurement device which measures an amount of dissolved gas contained in the liquid supplied to the inkjet head; and a flow volume control device which controls a volume of the liquid passing through the third flow channel according to the amount of dissolved gas measured by the dissolved gas amount measurement device.

4. The inkjet recording apparatus as defined in claim 3, further comprising:

a liquid consumption volume calculation device which calculates a liquid consumption volume consumed by the inkjet head in accordance with input image data and a number of prints; and a liquid supply volume control device which controls a volume of liquid supplied to the first liquid chamber from the tank, by controlling the first liquid movement device according to the liquid consumption volume calculated by the liquid consumption volume calculation device.

5. The inkjet recording apparatus as defined in claim 2, further comprising:

a liquid consumption volume calculation device which calculates a liquid consumption volume consumed by the inkjet head in accordance with input image data and a number of prints; and a liquid supply volume control device which controls a volume of liquid supplied to the first liquid chamber from the tank, by controlling the first liquid movement device according to the liquid consumption volume calculated by the liquid consumption volume calculation device.

6. The inkjet recording apparatus as defined in claim 1, further comprising:

a dissolved gas amount measurement device which measures an amount of dissolved gas contained in the liquid supplied to the inkjet head; and a flow volume control device which controls a volume of the liquid passing through the third flow channel according to the amount of dissolved gas measured by the dissolved gas amount measurement device.

7. The inkjet recording apparatus as defined in claim 6, further comprising:

a liquid consumption volume calculation device which calculates a liquid consumption volume consumed by the inkjet head in accordance with input image data and a number of prints; and a liquid supply volume control device which controls a volume of liquid supplied to the first liquid chamber from the tank, by controlling the first liquid movement device according to the liquid consumption volume calculated by the liquid consumption volume calculation device.

8. The inkjet recording apparatus as defined in claim 1, further comprising:

a liquid consumption volume calculation device which calculates a liquid consumption volume consumed by the inkjet head in accordance with input image data and a number of prints; and a liquid supply volume control device which controls a volume of liquid supplied to the first liquid chamber from the tank, by controlling the first liquid movement device according to the liquid consumption volume calculated by the liquid consumption volume calculation device.

9. The inkjet recording apparatus as defined in claim 1, wherein an interior of the tank is connected to outside air.

10. The inkjet recording apparatus as defined in claim 1, wherein:

two sub tanks each having a liquid chamber and a gas chamber formed by partitioning an interior of a sealed container by means of a flexible film are provided; and the liquid chamber of one of the two sub tanks serves as the first liquid chamber and the liquid chamber of the other of the two sub tanks serves as the second liquid chamber.

11. An inkjet recording apparatus, comprising:

a tank inside which liquid is stored;

a first flow channel through which the liquid inside the tank is supplied to an inkjet head;

a first liquid chamber which is provided at an intermediate point of the first flow channel and which temporarily holds the liquid supplied from the tank;

a second flow channel through which the ink circulated inside the inkjet head is returned to at least one of the tank and the first flow channel;

a second liquid chamber which is provided at an intermediate point of the second flow channel and which temporarily holds the liquid recovered from the inkjet head;

a first liquid movement device which is provided at the intermediate point of the first flow channel;

a second liquid movement device which is provided at the intermediate point of the second flow channel;

a first pressure determination device which determines an internal pressure of the first liquid chamber;

a second pressure determination device which determines an internal pressure of the second liquid chamber;

a pressure control device which sets respective target pressures for the first and second liquid chambers in such a manner that while a prescribed back pressure is applied to the liquid inside nozzles of the inkjet head, a prescribed pressure differential is provided between the first and second liquid chambers, and which controls pressures in the first and second liquid chambers by respectively controlling the first and second liquid movement devices, in accordance with determination results of the first and second pressure determination devices, in such a manner that the internal pressures of the first and second liquid chambers respectively remain at the target pressures;

a circulation path through which the liquid inside the first liquid chamber is circulated without passing through the inkjet head;

a deaeration device which is provided at an intermediate point of the circulation path and which removes dissolved gas in the liquid, wherein the circulation path is provided with at least one of a third liquid movement device and the first and second liquid movement devices; and a third flow channel of which both ends are respectively connected to the first liquid chamber, wherein:

the third liquid movement device and the deaeration device are provided at an intermediate point of the third flow channel; and the circulation path includes the third flow channel.

12. The inkjet recording apparatus as defined in claim 11, further comprising:

a dissolved gas amount measurement device which measures an amount of dissolved gas contained in the liquid supplied to the inkjet head; and a flow volume control device which controls a volume of the liquid passing through the third flow channel according to the amount of dissolved gas measured by the dissolved gas amount measurement device.

13. The inkjet recording apparatus as defined in claim 12, further comprising:

a liquid consumption volume calculation device which calculates a liquid consumption volume consumed by the inkjet head in accordance with input image data and a number of prints; and a liquid supply volume control device which controls a volume of liquid supplied to the first liquid chamber from the tank, by controlling the first liquid movement device according to the liquid consumption volume calculated by the liquid consumption volume calculation device.

14. The inkjet recording apparatus as defined in claim 11, further comprising:

a liquid consumption volume calculation device which calculates a liquid consumption volume consumed by the inkjet head in accordance with input image data and a number of prints; and a liquid supply volume control device which controls a volume of liquid supplied to the first liquid chamber from the tank, by controlling the first liquid movement device according to the liquid consumption volume calculated by the liquid consumption volume calculation device.

15. An inkjet recording apparatus, comprising:

a tank inside which liquid is stored;

a first flow channel through which the liquid inside the tank is supplied to an inkjet head;

a first liquid chamber which is provided at an intermediate point of the first flow channel and which temporarily holds the liquid supplied from the tank;

a second flow channel through which the ink circulated inside the inkjet head is returned to at least one of the tank and the first flow channel;

a second liquid chamber which is provided at an intermediate point of the second flow channel and which temporarily holds the liquid recovered from the inkjet head;

a first liquid movement device which is provided at the intermediate point of the first flow channel;

a second liquid movement device which is provided at the intermediate point of the second flow channel;

a first pressure determination device which determines an internal pressure of the first liquid chamber;

a second pressure determination device which determines an internal pressure of the second liquid chamber;

a pressure control device which sets respective target pressures for the first and second liquid chambers in such a manner that while a prescribed back pressure is applied to the liquid inside nozzles of the inkjet head, a prescribed pressure differential is provided between the first and second liquid chambers, and which controls pressures in the first and second liquid chambers by respectively controlling the first and second liquid movement devices, in accordance with determination results of the first and second pressure determination devices, in such a manner that the internal pressures of the first and second liquid chambers respectively remain at the target pressures;

a circulation path through which the liquid inside the first liquid chamber is circulated without passing through the inkjet head;

a deaeration device which is provided at an intermediate point of the circulation path and which removes dissolved gas in the liquid, wherein the circulation path is provided with at least one of a third liquid movement device and the first and second liquid movement devices;

a liquid consumption volume calculation device which calculates a liquid consumption volume consumed by the inkjet head in accordance with input image data and a number of prints; and a liquid supply volume control device which controls a volume of liquid supplied to the first liquid chamber from the tank, by controlling the first liquid movement device according to the liquid consumption volume calculated by the liquid consumption volume calculation device.

* * * * *